US007285718B2

(12) United States Patent
Sasaki

(10) Patent No.: US 7,285,718 B2
(45) Date of Patent: Oct. 23, 2007

(54) KEYBOARD MUSICAL INSTRUMENT AND OTHER-TYPE MUSICAL INSTRUMENT, AND METHOD FOR GENERATING TONE-GENERATION INSTRUCTING INFORMATION

(75) Inventor: Tsutomu Sasaki, Shizuoka-ken (JP)

(73) Assignee: Yamaha Corporation, Shizuoka-Ken (JP)

( * ) Notice: Subject to any disclaimer, the term of this patent is extended or adjusted under 35 U.S.C. 154(b) by 213 days.

(21) Appl. No.: 11/019,985

(22) Filed: Dec. 21, 2004

(65) Prior Publication Data

US 2005/0145104 A1 Jul. 7, 2005

(30) Foreign Application Priority Data

Dec. 22, 2003 (JP) ..... 2003-425650
Dec. 24, 2003 (JP) ..... 2003-428461
Sep. 21, 2004 (JP) ..... 2004-273629
Sep. 21, 2004 (JP) ..... 2004-274021

(51) Int. Cl.
*G10H 1/32* (2006.01)
*G10H 3/00* (2006.01)

(52) U.S. Cl. ..... 84/744; 84/626; 84/658; 84/719

(58) Field of Classification Search ..... None
See application file for complete search history.

(56) References Cited

U.S. PATENT DOCUMENTS 5,583,310 A 12/1996 Sugiyama et al.
5,627,333 A * 5/1997 Stahnke et al. ..... 84/462
5,648,621 A * 7/1997 Sasaki ..... 84/171
5,731,530 A 3/1998 Fujiwara et al.
6,051,762 A * 4/2000 Fujiwara et al. ..... 84/21
6,359,207 B1 * 3/2002 Oba et al. ..... 84/658
6,403,872 B2 6/2002 Muramatsu et al.
6,940,005 B2 * 9/2005 Muramatsu et al. ..... 84/21
2001/0035086 A1 * 11/2001 Sugiyama et al. ..... 84/423 R
2002/0194986 A1 12/2002 Kato et al.
2003/0131717 A1 7/2003 Shiiya

FOREIGN PATENT DOCUMENTS

JP 4361294 12/1992
JP 9134172 5/1997
JP 2001-175262 6/2001

* cited by examiner

*Primary Examiner*—Marlon Fletcher
(74) *Attorney, Agent, or Firm*—Harness, Dickey & Pierce, PLC

(57) ABSTRACT

Detector detects movement of a hammer (driven member) that strikes a string (abutted member) by moving in response to operation of a key. On the basis of detection outputs of the detector and a given abutment-presuming reference value, it is presumed that the hammer has struck or abutted against the string. For example, performance event data is generated on the basis of the abutment presumption. In order to minimize errors due to variation over time or aging of a hammer action mechanism, a determination section determines that the hammer has, actually or with a high probability, reached an abutting position where the hammer abuts against the string, and the abutment-presuming condition in accordance with the determination result. It is determined that the hammer has reached the abutting position, by comparing, on the basis of detection outputs of the detector, movement of the hammer toward the string and movement of the hammer away from the string. By thus making a string-striking determination in view of operation of the hammer not only before the string striking but also after the string striking, it is possible to accurately determine whether or not the string has been struck.

20 Claims, 9 Drawing Sheets

TABLE1

| | | |
|---|---|---|
| 1 | AD VALUE | TIME |
| 2 | AD VALUE | TIME |
| 3 | AD VALUE | TIME |
| ⋮ | ⋮ | ⋮ |
| 20 | AD VALUE | TIME |

TABLE2

| | VELOCITY | ACCELERATION |
|---|---|---|
| AD(−5),t(−5) | | |
| AD(−4),t(−4) | v(−4) | a(−4) |
| AD(−3),t(−3) | v(−3) | a(−3) |
| AD(−2),t(−2) | v(−2) | a(−2) |
| AD(−1),t(−1) | v(−1) | a(−1) |
| AD(0),t(0) | v(0) | a(0) |
| AD(1),t(1) | v(1) | a(1) |
| AD(2),t(2) | v(2) | a(2) |
| AD(3),t(3) | v(3) | a(3) |
| AD(4),t(4) | v(4) | a(4) |
| AD(5),t(5) | v(5) | |

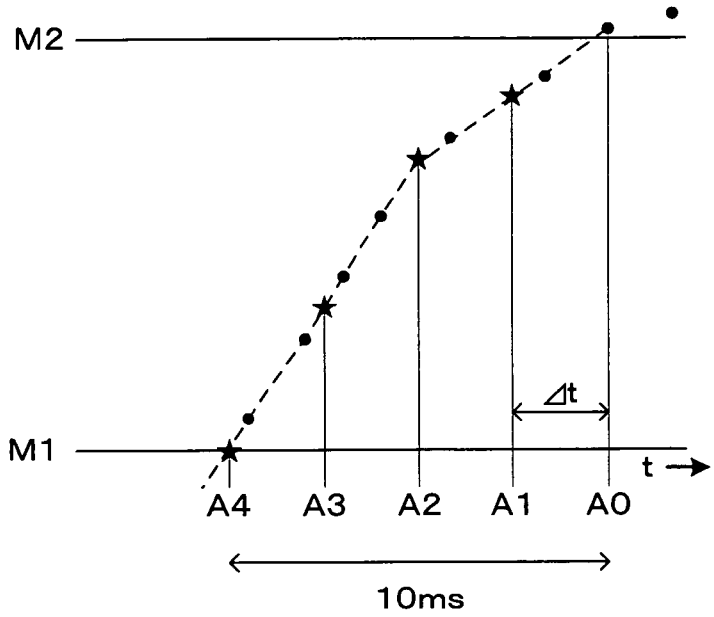
FIG. 12A
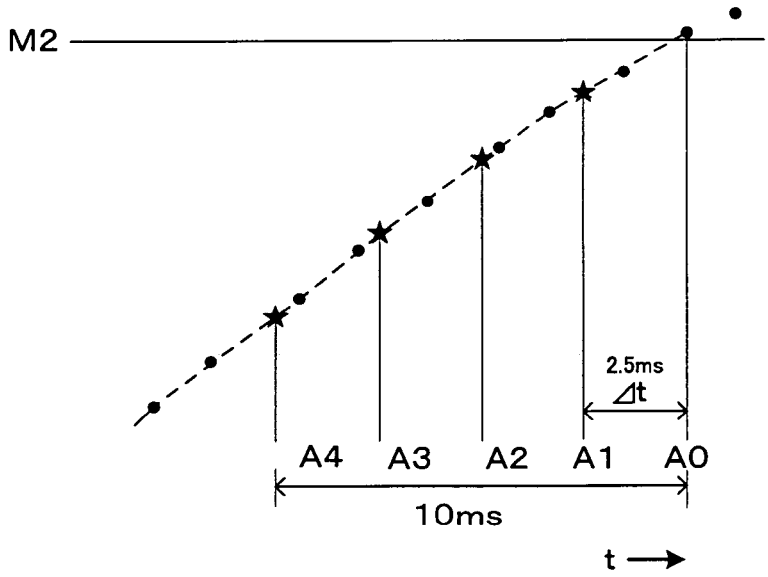
FIG. 12B
| | |
|---|---|
| 0 | AD0 |
| 1 | AD1 |
| 2 | AD2 |
| 3 | AD3 |
| 4 | AD4 |
| TIME |
|---|
| ⊿t |
FIG. 12C

KEYBOARD MUSICAL INSTRUMENT AND OTHER-TYPE MUSICAL INSTRUMENT, AND METHOD FOR GENERATING TONE-GENERATION INSTRUCTING INFORMATION

BACKGROUND OF THE INVENTION

The present invention relates generally to keyboard musical instruments, such as pianos, and more particularly to a technique for sensing given performance-related movement and determining a time point of string-striking operation on the basis of the sensed results.

The present invention also relates to a technique which is suitable applicable to musical instruments, such as pianos, arranged to generate tones on the basis of operation of displacement members that reciprocatively move in response to movement of performance operators, and which, in such musical instruments, determines time points string-striking movement or operation on the basis of the operation of the displacement members.

In the field of keyboard musical instruments, such as automatic player pianos, it has been a common practice to detect movement of keys, hammers, etc. via sensors so as to record detected results as performance data or supply the detected results to an electronic tone generator for electronic generation of tones. In creating performance data etc. in such automatic player pianos by use of detected time points and velocities of string-striking operation, there is a need to acquire string-striking time points and velocities with an enhanced accuracy; therefore, automatic player pianos have been known which are provided with hammer sensors for detecting operation or movement of hammers. Japanese Patent Application Laid-open Publication No. 2001-175262 discloses an example of a keyboard musical instrument provided with hammer sensors. The disclosed keyboard musical instrument includes hammer sensors (or successive physical amount sensors) for successively detecting displacement of corresponding hammer shanks. As one of the keys is operated in the disclosed keyboard musical instrument, the hammer sensor (successive physical amount sensor) successively detects physical amounts (e.g., position, velocity or acceleration) of movement or displacement of the corresponding hammer. Using such detection results, the keyboard musical instrument acquires various performance-related information, such as (1) a time point at which the hammer has started moving (i.e., hammer-movement start time point), (2) a time point at which the corresponding string has been struck (i.e., string-striking time point), (3) a moving velocity of the hammer (i.e., hammer velocity) immediately before the string striking, (4) a time point at which the key has been depressed (i.e., key-depression time point), (5) a back check time point, (6) a time point at which the back check has disengaged, (7) a hammer velocity after the back check has disengaged, (8) a time point at which the damper has started returning to its home or rest position (i.e., damper-return start time point), (9) a time point at which the hammer has stopped moving (i.e., hammer-movement end time point), and (10) a time point at which the key has been released (i.e., key-release time point). Namely, the disclosed keyboard musical instrument is arranged to successively detect various physical amounts related to the movement of the hammer, perform arithmetic operations on the sensor outputs as appropriate to acquire various information as enumerated above and then create performance data based on the acquired various information. In this way, the disclosed keyboard musical instrument permits creation of performance data capable of reproducing a performance with an increased accuracy and precision.

For example, in order to generate the information of the string-striking time point and hammer velocity immediately before string striking, the conventional apparatus, represented by the disclosed instrument of the No. 2001-175262 publication, determine whether or not any one of the strings has been struck, on the basis of a comparison between the outputs from the successive physical amount sensor and a predetermined reference value, and use the determination result to generate the required information. Because, the above-mentioned various information is generated on the basis of the outputs from the successive physical amount sensor and predetermined reference value, the conventional apparatus would present the inconvenience that the various information tends to fail to accurately correspond to actual performance states (operating states of the hammer) if input/output characteristics of the sensor vary due to variation in temperature, deterioration over time (i.e., aged deterioration or aging), etc., as a result of which the output information would undesirably become inaccurate.

Further, according to the conventional apparatus arrangements, represented by those of the disclosed keyboard musical instrument in the laid-open publication, in order to generate various information related to a piano performance, a control system of the apparatus is arranged to judges operating states of the hammer through hammer-operation determination processes, such as a determination of a start of the hammer movement and a determination as to whether the hammer in question has struck the string (i.e., string-striking determination). Specifically, it has been conventional to determine the operating states of the hammer by comparing the outputs of the hammer sensor and predetermined threshold values, to thereby associate the sensor outputs with operating positions of the hammer and then judge the operating states of the hammer on the basis of the operating positions of the hammer. However, with the conventional technique, the string-striking determination, intended to acquire the string-striking time point etc., is made solely on the basis of only movement of the hammer when approaching the string (i.e. only movement of the hammer before striking the string, so that the determination as to whether or not the hammer has struck the string (i.e., string-striking determination) tends to be unreliable. Furthermore, input/output characteristics of an optical sensor, used as the successive physical amount sensor, may present unwanted variation over time (i.e., aging), such as a light amount decrease during use of the sensor. However, the conventional apparatus can not appropriately deal with such undesired variation over time in the input/output characteristics of the optical sensor (e.g., light amount decrease).

SUMMARY OF THE INVENTION

In view of the foregoing, it is a first object of the present invention to provide an improved musical instrument which can appropriately correct any determination error resulting from undesired variation over time or aging of a performance-operation/movement converting or transmitting mechanism, such as an action mechanism of a keyboard.

It is a second object of the present invention to provide an improved technique which is suitably applicable to a musical instrument, such as an automatic player piano, where a tone is generated on the basis of movement or operation of a displacement member reciprocatively movable in response to operation of a performance operator, and which, in such a musical instrument, can accurately make a string-striking determination based on the movement of the displacement member and accurately make a determination as to whether or not tone-generation instructing information should be generated.

In order to accomplish the above-mentioned first object, the present invention provides an improved musical instrument, which comprises: a performance operator; a driven member that is mechanically driven in response to operation of the performance operator so as to abut against an abutted member; a detector that detects movement of the driven member; a presumption section that, on the basis of outputs of the detector and a given abutment-presuming reference value, presumes whether the driven member has abutted against the abutted member; a determination section that determines that the driven member mechanically driven has reached an abutting position where the driven member abuts against the abutted member; and a correction section that corrects an abutment-presuming condition to be used by the presumption section, in accordance with a determination result of the determination section.

In the musical instrument of the present invention, on the basis of the detection outputs of the detector and the abutment-presuming reference value, the presumption section presumes that the driven member has abutted against the abutted member; thus, the presumption section can presume, substantially in real time responsive to operation of the performance operator, that the driven member has abutted against the abutted member. Therefore, by generating performance operation event information etc. using the presumption result of the presumption section, it is possible to appropriately deal with a real-time performance without any problem. If, however, there arises an error in a movement converting or transmitting mechanism, which drives the driven member in response to movement of the performance operator, due to undesired variation over time (or aging) etc., the presumption by the presumption section would present poor reliability unless appropriate compensation is made. Thus, in the present invention, the presumption section determines that the driven member has, actually or with a high probability, reached the abutting position where the driven member abuts against the abutted member. Because the determination result that the driven member has reached the abutting position can be obtained approximately when actual abutment of the driven member against the abutted member has occurred or immediately after the abutment, the determination result is not suitable for use in generation of necessary performance operation event information etc; however, the determination result can be used as highly-accurate abutment determination information. Thus, with the correction section that corrects the abutment-presuming condition of the presumption section in accordance with the determination result of the determination section, it is possible to appropriately compensate for or calibrate an error in the movement converting or transmitting mechanism (which drives the driven member in response to movement of the performance operator) due to undesired variation over time, aging etc. For example, in the present invention, the abutment-presuming condition of the presumption section is corrected by calibrating at least one of the output of the detector and the abutment-presuming reference value to be used in the presumption section. In this way, the presumption by the presumption section can be made more reliable. As a consequence, the present invention can appropriately correct errors in a key-on determination and the like attributable to undesired variation over time, aging etc. of, for example, an action mechanism of a piano keyboard.

In order to accomplish the second object of the present invention, the present invention provides an improved musical instrument, which comprises: a performance operator; a displacement member that reciprocatively moves in response to operation of the performance operator so as to abut against an abutted member; a detector that successively detects operation of the displacement member; and a determination section that determines that the displacement member has reached an abutting position where the displacement member abuts against the abutted member, by comparing, on the basis of detection outputs of the detector, movement of the displacement member toward the abutted member and movement of the displacement member away from the abutted member.

In the present invention, the detector detects movement or operation of the displacement member in successive amounts. The determination section determines that the displacement member has reached the position for abutment against the abutted member (i.e., abutting position), by comparing, on the basis of the detection outputs of the detector, movement of the displacement member approaching the abutted member and movement of the displacement member moving away from the abutted member. As one example, the determination for the abutment between the performance operator and the displacement member may be a string-striking determination as to whether a key has been struck by a hammer. By making a string-striking determination in view of operation of the hammer not only before the string striking but also after the string striking, it is possible to determine, with an increased accuracy, whether or not the string has been struck by the hammer. The detector detects, for example, position information of the hammer in successive amounts. The determination section calculates at least one of velocity information and acceleration information of the movement of the hammer on the basis of an approximate expression based on detection outputs provided by the detector at a plurality of time points, and it then compares, on the basis of a transition over time of the calculated, at least one of the velocity and acceleration information, movement of the hammer approaching the string before string the string and movement of the hammer moving away from the string after striking the string. In this way, the determination section can accurately determine whether the string has been actually struck by the hammer.

According to another aspect of the present invention, there is provided an improved musical instrument, which comprises: a performance operator; a displacement member that reciprocatively moves in response to operation of the performance operator so as to control tone generation by a tone generation section; a detector that detects movement of at least one of the performance operator and the displacement member; a position determination section that determines, on the basis of outputs of the detector, whether the displacement member has reached a predetermined position; a velocity information generation section that acquires velocity information of the displacement member on the basis of the outputs of the detector; a velocity determination section that determines whether a velocity indicated by the velocity information outputted by the velocity information generation section has exceeded a predetermined velocity; and a tone-generation instructing information generation section that generates tone-generation instructing information on the basis of determination results of the position determination section and the velocity determination section. When the velocity determination section determines that the velocity indicated by the velocity information has exceeded the predetermined velocity, the tone-generation instructing information generation section generates tone-generation instructing information on the basis of at least the velocity information obtained during outward movement of the displacement member toward the predetermined position, but, when the velocity determination section determines that the velocity indicated by the velocity information has not exceeded the predetermined velocity, the tone-generation instructing information generation section generates tone-generation instructing information on the basis of at least the velocity information obtained during homeward movement of the displacement member away from the predetermined position.

As an example, the performance operator may be a key, and the displacement may be a hammer that strikes a string in response to movement of the key. In such a case, the present invention can accurately generate tone-generation instructing information (and accurately prevent generation of unnecessary tone-generation instructing information) in view of both a stroke position of the hammer and an operating velocity of the hammer. Namely, when the velocity of the hammer has exceeded the predetermined velocity, tone-generation instructing information can be generated on the basis of at least operation of the hammer during outward movement of the hammer (before striking the string). Even when the velocity of the hammer has not exceeded the predetermined velocity, tone-generation instructing information can be generated, taking, into account, operation of the hammer during homeward movement (after the string striking) as well as the operation of the hammer during the outward movement. Therefore, the present invention can advantageously generate more accurate tone-generation instructing information in view of the operation of the hammer detected not only before the string striking but also after the string striking.

The present invention may be constructed and implemented not only as the apparatus invention as discussed above but also as a method invention. Also, the present invention may be arranged and implemented as a software program for execution by a processor such as a computer or DSP, as well as a storage medium storing such a software program. Further, the processor used in the present invention may comprise a dedicated processor with dedicated logic built in hardware, not to mention a computer or other general-purpose type processor capable of running a desired software program.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the object and other features of the present invention, its preferred embodiments will be described hereinbelow in greater detail with reference to the accompanying drawings, in which:

FIGS. 12A and 12B are conceptual diagrams explanatory of how equally-spaced sampling points are extracted for calculation of a hammer velocity in the automatic player piano of the present invention, and FIG. 12C is a diagram showing an example construction of another table.

DETAILED DESCRIPTION OF THE INVENTION

Description will hereinafter be made about a first embodiment of the present invention, with reference to FIGS. 1-9.

Figure 1:
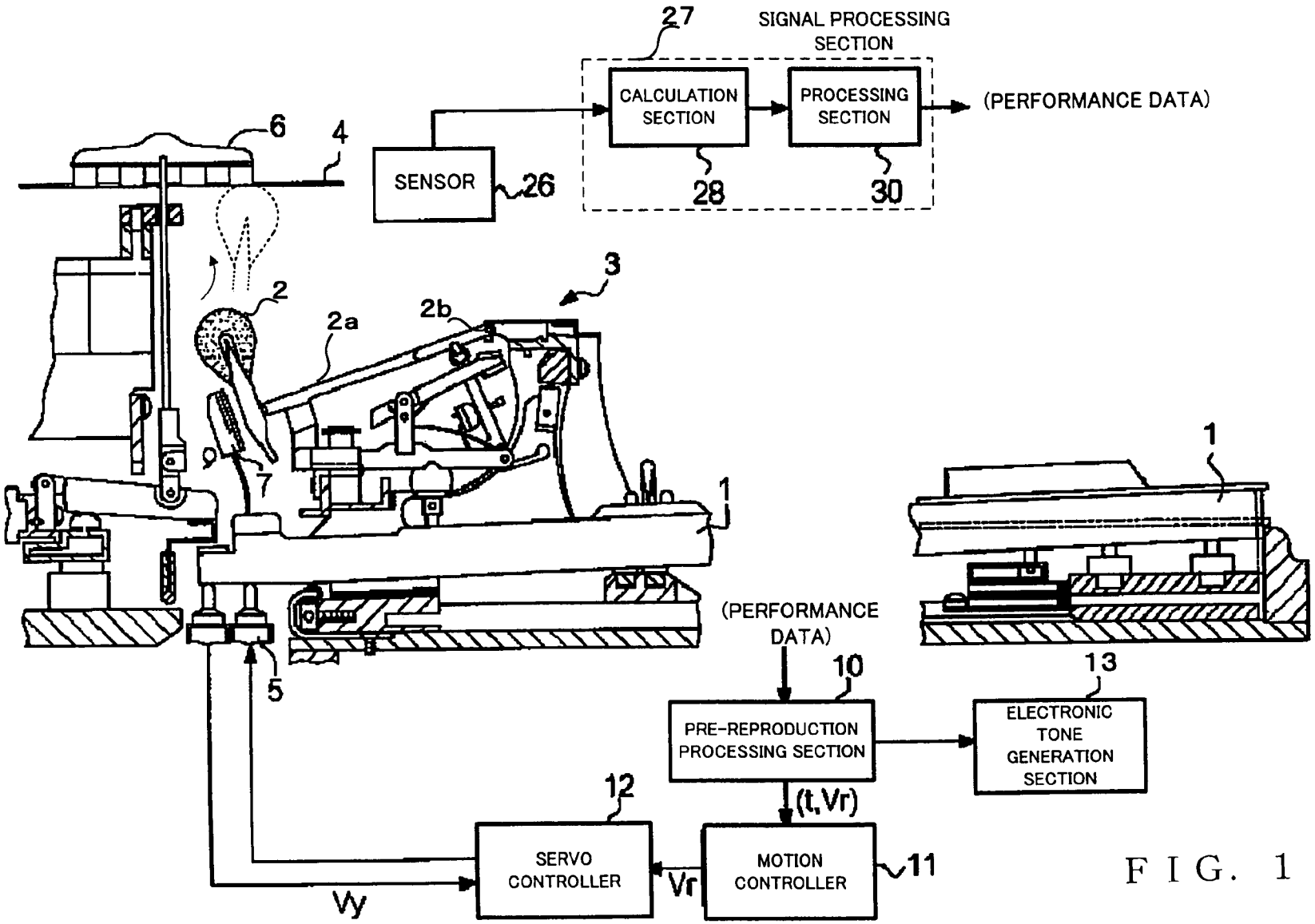
FIG. 1 is a diagram explanatory of an example general setup of an automatic player piano in accordance with an embodiment of the present invention.

FIG. 1 is a diagram explanatory of an example general setup of an automatic player piano in accordance with a first embodiment of the present invention, which particularly shows principal sections of a mechanical tone generation mechanism and functions of an electric control system of the player piano. As shown in the figure, the mechanical tone generation mechanism of the automatic player piano includes a key 1, a hammer 2 movable along an arcuate movement (stroke) path in response to operation or movement of the key 1, an action mechanism 3 for transmitting the movement of the key 1 to the hammer 2, a string 4 for being struck by the hammer 2, an electromagnetic solenoid 5 for driving the key 1 on the basis of electric control, and a damper 6 for damping vibrations of the string 4, similarly to those employed in the conventional automatic player pianos. Let it be assumed that the instant embodiment employs arrangements for servo-controlling driving of the electromagnetic solenoid 5 and that a feedback sensor is provided for detecting operation of a plunger (not shown) of the electromagnetic solenoid 5.

Further, the automatic player piano of the present invention includes a back check 7 similarly to the conventional acoustic pianos; the back check 7 functions to prevent the hammer 2 from moving violently due to a reaction resulting from striking of the string 4. In addition, the automatic player piano of the present invention includes various other components similar to those of the conventional acoustic pianos, description and illustration of which will be omitted here. The hammer 2 is operatively connected via a hammer shank 2*a* to the action mechanism 3 for vertical movement along the arcuate movement (stroke) path via a pivot shaft 2*b*. While the corresponding key 1 is not depressed (i.e., no external force is applied to the key 1), the key 1 is held in a rest position, i.e. in a position of a zero-mm stroke amount, as illustrated in FIG. 1. Essentially, the hammer 2 pivotally moves from the rest position to a predetermined end position (i.e., extreme operating position opposite to the rest position), in response to performance operation (vertical pivotal movement) of the corresponding key 1. The illustrated example also assumes that the end position of the hammer 2 is displaced 48 mm from the rest position along the stroke path. In the figure, the hammer 2 in the end position is illustrated in dotted lines. Note that the "end position" is a position where the hammer (i.e., driven movable member) 2 strikes the string (i.e., member to be struck by the hammer) 4.

Further, in FIG. 1, reference 26 represents a hammer sensor (or successive physical amount sensor) for detecting displacement of the hammer in successive amounts, and a signal processing section 27 is a module for receiving the output signals from the hammer sensor 26 and performing various processes on the received output signals. Note that only one key 1, hammer 2, action mechanism 3, string 4, solenoid 5, etc. are shown in the figure for simplicity although, in practice, there are provided a plurality of such keys 1, hammers 2, action mechanisms 3, strings 4, solenoids 5, etc.

The hammer sensor (or successive physical amount sensor) 26 may be in the form of an optical position sensor capable of detecting and outputting successive position information of the hammer 2. The optical position sensor, employed in the instant embodiment for successively detecting the position of the hammer 2, includes a light-emitting-side sensor head coupled via an optical fiber with an LED and a light-receiving-side sensor head coupled via an optical fiber with a photo diode. Light of the LED is irradiated from the light-emitting-side sensor head, then received by the light-receiving-side sensor head coupled via the optical fiber with the photo diode, and an output voltage corresponding to the received light amount can be taken out via the photo diode. The hammer sensor 26 is constructed in such a manner that the light amount received by the light-receiving-side sensor head varies in response to displacement of the movable member (hammer in this case) 2; in this way, the output voltage corresponding to the current stroke position of the hammer 2 can be provided as the output of the hammer sensor 26. Heretofore, there have been known various schemes for varying the received light amount at the light-receiving-side sensor head in response to the stroke position of the hammer 2. As an example, the instant embodiment may employ one of the conventionally-known schemes, in accordance with which the light emitted from the LED is irradiated onto a reflective plate having a grayscale formed thereon and resultant reflected light from the reflective plate is received by the light-receiving-side sensor head (photo diode). According to such a scheme, variation in the light amount received by the light-receiving-side sensor head presents increase/decrease characteristics corresponding to a density pattern of the grayscale, and thus it is possible to obtain desired sensor output characteristics corresponding to the density pattern. As a consequence, the instant embodiment can advantageously provide analog data, as output signals of the sensor 26, presenting linear (proportional) characteristics with respect to the displacement of the hammer 2.

Each voltage value (analog signal) output from the hammer sensor 26 is supplied, via an operational amplifier and A/D converter (not shown), to the signal processing section 27 as a digital signal. The output signal of the hammer sensor 26, having been converted to the digital signal, will hereinafter be referred to as "A/D (Analog-to-Digital-converted) value". The "A/D value" is data that expresses the output of the hammer sensor 26 (i.e., measured value of the current position of the hammer 2) using a numerical value in the range of "0"-"1023". If the separate hammer sensor 26 (including the LED and photo diode) is provided for each of the hammers (e.g., 88 hammers) in the automatic player piano, the necessary cost will increase considerably. To avoid the cost increase, the assignee of the instant application proposed, in Japanese Patent Application Laid-open Publication No. HEI-9-54584, a technique, in accordance with which a sensor matrix capable of individually sensing movement each of the 88 (eighty eight) hammers is constructed using twelve LEDs and eight photo diodes. Let it be assumed that the hammer sensor 26 in the instant embodiment comprises such a sensor matrix. In an alternative, however, the separate hammer sensor 26, including the LED and photo diode, may be provided for each of the hammers in the automatic player piano of the present invention. Whereas the following description focuses only on the hammer sensor 26 that detects a position of the hammer 2, other sensors may be employed for detecting movement of the keys and/or other suitable movable members.

The signal processing section 27 includes a CPU, a ROM, a RAM, a timer, etc., and it performs various processes and control, such as a process for calculating various information related to performance operation of the automatic player piano on the basis of the signals (A/D values) supplied from the hammer sensor 26 and process for generating and recording performance information based on the performance-related information. In FIG. 1, a calculation section 28, included in the signal processing section 27, performs a process for generating various information, related to performance operation of the automatic player piano, on the basis of movement of the hammer 2 represented by the A/D values supplied from the hammer sensor 26. More specifically, the calculation section 28 performs the process for obtaining, from the A/D values (i.e., data indicative of an operating position of the hammer 2) supplied from the hammer sensor 26, physical information, such as velocity information and acceleration information, and generates various performance-related information of the types mentioned in the above-discussed No. 2001-175262 laid-open publication, such as a string-striking time point and velocity, on the basis of the physical information of the hammer 2, such as position, velocity and acceleration information. Processing section 30 performs the process for generating performance information corresponding to the performance-related information generated by the calculation section 28. The thus-generated performance information may be output from the processing section 30 to be recorded on a suitable recording medium or supplied to an external apparatus (not shown) via an input/output interface (also not shown). In an alternative, the generated performance information may be supplied in real time from the processing section 30 to another apparatus via a communication network (not shown). As will be later described, the signal processing section 27 in the instant embodiment determines, using the A/D values supplied from the hammer sensor 26, whether or not the string 4 has been struck by the hammer 2 and it performs an appropriate correction process for correcting a determination error, so that it can perform an accurate string-striking determination without being influenced by undesired variation over time or aging of the action mechanism 3.

Here, with reference to FIG. 1, a description is made about a reproduction control system, provided in the automatic player piano of the invention, for performing an unattended performance (i.e., automatic player piano function) based on the performance information.

Pre-reproduction processing section 10 of FIG. 1 generates key movement trajectory data for reproducing various performance events, included in the performance information, on the basis of performance information supplied from a suitable recording medium, real-time communication apparatus or the like. The pre-reproduction processing section 10 also generates an original velocity indicating value (t, Vr) of the key using the movement trajectory data. On the basis of the original velocity indicating value (t, Vr), a motion controller 11 generates and outputs a velocity indicating value Vr corresponding to a position of the key 1 at a time point t. Servo controller 12 supplies the electromagnetic solenoid 5 with an exciting current corresponding to the velocity indicating value Vr, and it compares an output velocity (feedback signal) Vy fed back from the solenoid 5 and the velocity indicating value Vr to perform servo control so that the compared output velocity Vy and velocity indicating value Vr agree with, i.e. match, each other. In addition to the above-described mechanical tone generation control based on the driving of the solenoid 5, the pre-reproduction processing section 10 performs an operation for supplying control signals to an electronic tone generation section 13, comprising a tone generator, speaker etc., on the basis of performance data supplied from the recording medium or real-time communication apparatus or the like. The electronic tone generation section 13 electronically generates a tone on the basis of the supplied control signals; in this way, a performance tone corresponding to the performance information can be generated. The performance data, on the basis of which the electronic tone generation section 13 electronically executes an automatic performance in the above-described manner, may be of any desired conventionally-known data format, and the electronic tone generation section 13 may employ any desired conventionally-known tone generation method.

Operations performed by the automatic player piano of the invention for recording and reproduction the performance information are outlined below. As a human player executes a piano performance, the signal processing section 27 generates various performance-related information on the basis of the detected results supplied from the hammer sensor 26, and then, on the basis of the performance-related information, generates performance information representative of contents of the piano performance by the human operator. Note that the performance information may be created in any suitable data format, such as the MIDI format. The thus-generated performance information may be recorded on a suitable recording medium, such as a hard disk, flexible disk or floppy (trademark) disk, compact disk (CD-ROM), magneto-optical disk (MO), ZIP disk, DVD (Digital Versatile Disk) or semiconductor memory.

For reproduction of the performance information via the automatic player piano of the invention, the user can select either a mechanical tone generation scheme in which each predetermined key 1 is driven by the electromagnetic solenoid 5 to cause the hammer 2 to strike the corresponding string 4, or an electronic tone generation scheme using the electronic tone generation section 13. In the mechanical tone generation scheme, driving of the electromagnetic solenoid 5 is controlled, by drive signals (exciting currents) corresponding to the performance information to be reproduced, to reproduce key trajectories (key strokes) corresponding to the performance information, and then string-striking operation by the key 2 is controlled to execute a piano performance corresponding to the performance information. In the electronic tone generation scheme, the pre-reproduction processing section 10 controls the electronic tone generation section 13 in accordance with the performance information to be reproduced, so that tones corresponding to the supplied performance information are electronically generated by the electronic tone generation section 13.

In a performance recording process for recording the performance executed by the human player, the automatic player piano of the present invention determines, from the hammer-movement indicating physical amounts detected by the hammer sensor 26, that the corresponding string 4 has been struck by the hammer 2, in the following characteristic manner. Namely, as a novel feature of the present invention, that the hammer 2 has reached a predetermined string-striking position is presumed on the basis of a preset string-striking presuming reference value and the A/D values (i.e., position information of the hammer 2) output from the hammer sensor 26, and string-striking presumption information, indicative of presumed string striking, is generated. On the other hand, physical information (e.g., velocity information and acceleration information) of the hammer 2, separate from the position information of the hammer 2 indicative of movement of the hammer 2, is generated, and whether or not the string 4 has been struck by the hammer 2 is determined on the basis of the thus-generated physical information of the hammer 2 approaching the corresponding string 4 before striking the string 4 and the physical information of the hammer 2 leaving or moving away from the corresponding string 4 after the string striking. If the results of the string-striking presumption and the string-striking determination do not agree with, i.e. match, each other, a cause of the disagreement or mismatch is appropriately corrected to thereby permit a more accurate string-striking determination. Details of operations performed by the signal processing section 27 will be set forth below.

First, upon powering-on of the automatic player piano, the signal processing section 27 performs, for each of the hammers 2, an operation for setting "reference position parameters (reference values)" for associating the A/D values with actual operating positions of the hammer 2. Namely, a plurality of operating positions of the hammer 2 have been preset as reference positions, and A/D values representative of the reference positions of the hammer 2 are stored at this stage. The signal processing section 27 associates the A/D values, supplied in real time from the hammer sensor 26, with the reference positions and can judge an operating state of the hammer 2 in accordance with the associated reference positions. In the instant embodiment, it is assumed that, as such reference positions of the hammer 2, there are set four positions: a rest position (i.e., position of a zero-mm stroke amount); an end position (i.e., position of a 48-mm stroke amount from the rest position); a first reference position M1 (i.e., position 8 mm lower than the end position); and a second reference position M2 (i.e., position 0.5 mm lower than the end position). Note that the first reference position M1 and the second reference position M2 are defined as relative positions to the end position.

Figure 2:
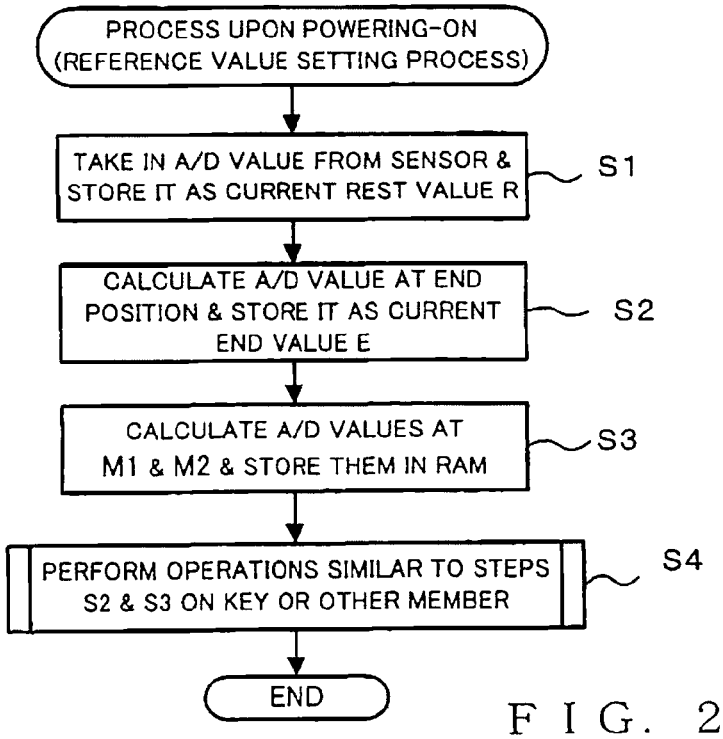
FIG. 2 is a flow chart showing an example operational sequence of a process carried out upon powering-on of the automatic player piano of the present invention shown in FIG. 1.

FIG. 2 is a flow chart showing an example operational sequence of the process for setting the reference values corresponding to the four reference positions, for each of the hammers 2 (and hence the keys 1), in the automatic player piano of the invention. First, upon powering-on of the automatic player piano, the hammer sensor 26 detects a current position of the hammer 2, and the A/D value output from the hammer sensor 26 is taken into the signal processing section 27 (step S1). Because, immediately after the powering-on, the key 1 can be assumed to be in its non-depressed position, i.e. the hammer 2 can be assumed to be in its rest position, the A/D value taken in from the hammer sensor 26 at this stage is stored into the RAM as a reference value, "rest value R", that can be referred to as data representing the rest position of the hammer 2. Such an A/D value take-in operation is carried out for each of the hammers 2 to acquire the rest value R for each of the hammers 2, so as to acquire the respective rest values R of all of the hammers 2. Then, at step S2, an "end value R" to be referred to as data representing the end position of the hammer 2 is calculated using a "calibration ratio" as will be later described, and the thus-calculated end value E is stored into the RAM. The operation of step S2 is also carried out for each of the hammers 2, so as to acquire the respective end values E of all of the hammers 2.

The "calibration ratio" represents a ratio of the A/D value at the end position to the A/D value at the rest position (see, for example, Japanese Patent Application Laid-open Publication No. 2000-155579). Here, an operation for setting the "calibration ratio" is explained briefly. This calibration ratio setting operation is carried out, for example, prior to factory shipment. In the calibration ratio setting operation, which is initiated in response to instructions from a controller (not shown) or the like, the A/D value at the rest position and the A/D value at the end position are measured, and the calibration ratio is calculated on the basis of the thus-measured A/D values at the rest and end positions. The calibration ratio setting operation is carried out for each of the 88 hammers, and the calibration ratio calculated for each of the hammers is recorded, for example, into a non-volatile memory, such as a flash memory. By only actually measuring the A/D value at the rest position of the hammer and using the calibration ratio, A/D values at any other desired operating positions, such as the end position, of the hammer may be calculated.

Although specific numerical values of the A/D values output from the hammer sensor 26 may vary due to various factors, such as aged deterioration and temperature variation, the ratio of the A/D value at the end (or other desired) position to the A/D value at the rest position can be considered to be fixed or invariable. Therefore, if only the A/D value at the rest position can be identified, the A/D value at the end (or other reference or desired) position corresponding to the identified A/D value at the rest position can be calculated, using the calibration ratio, irrespective of influences of the aged deterioration, temperature variation, etc. Namely, the calibration ratio setting operation carried out in the instant embodiment is advantageous in that it has to actually measure, via the hammer sensor 26, only the rest value R representing the rest position among the above-mentioned four reference positions (i.e., rest position, end position and first and second reference positions M1, M2) and can calculate the A/D value at any of the other reference positions using the actually-measured rest value R and calibration ratio.

Referring back to FIG. 2, step S3 is directed to calculating a "first reference value m1" and "second reference value m2" (which are to be referred to as A/D values representing the first reference position M1 and second reference position M2 of each of the hammers 2) using the calibration ratio and on the basis of the rest value R stored in the RAM. The thus-calculated reference values m1 and m2 are stored into the RAM, so that the first reference value m1 and second reference value m2 can be later referred to in a hammer velocity calculation process and string-striking determination process as will be later described.

For any other movable members than the hammers 2, such as the keys 1, similar reference position parameters may be set on the basis of the sensor outputs (step S4) upon powering-on of the player piano.

Figure 3:
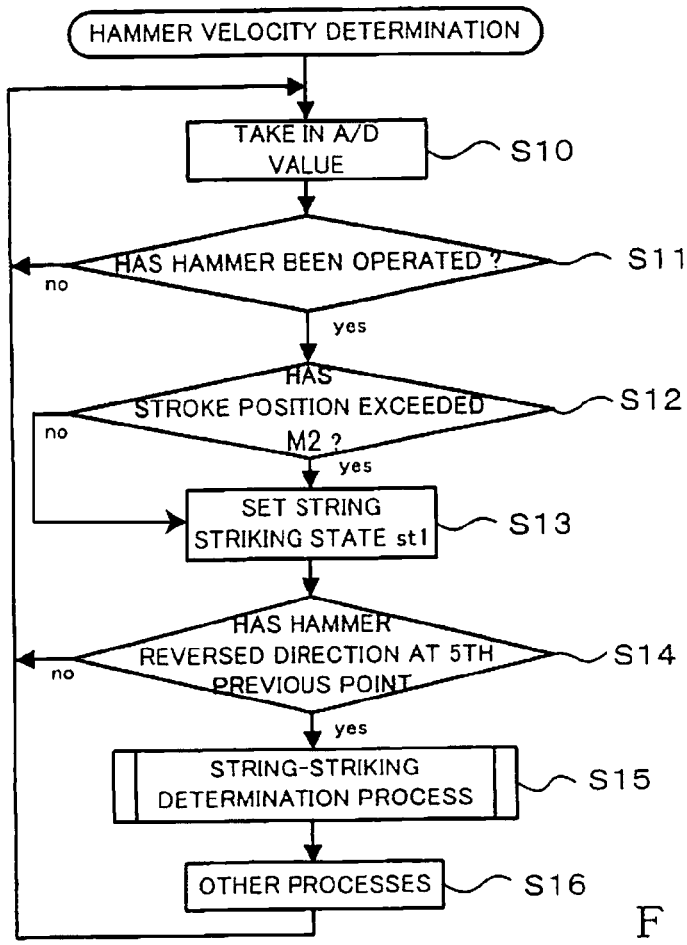
FIG. 3 is a flow chart showing an example operational sequence of a routine for determining a velocity of a hammer in the automatic player piano of the present invention.

FIG. 3 is a flow chart showing an example operational sequence of the routine executed by the signal processing section 27 for determining a velocity of the hammer 2. This hammer velocity determination routine is carried out as one of principal processes of the automatic player piano of the present invention, during normal operation of the automatic player piano, such as when contents of performance operation by the human player are recorded as performance information or when the performance information is reproduced. This hammer velocity determination routine is carried out separately for each of 88 keys 1 (i.e., hammers 2), but the following paragraphs representatively describe operations performed on only one of the keys 1 (hammers 2). The operating velocity information of the hammer 2 determined here is used as one of fundamental information not only in the determination as to presence/absence of string striking by the hammer 2 (i.e., as to whether or not the string 4 has been struck by the hammer 2, but also in outputting of various performance-related information, such as calculation of a string-striking time point, hammer velocity immediately before the string striking, etc. As illustrated in FIG. 3, operations at step S10-S16 in the hammer velocity determination routine are carried out, for each of the keys, repetitively in a looped manner at predetermined time intervals (i.e., routine triggering intervals).

Figures 4, 5, 10:
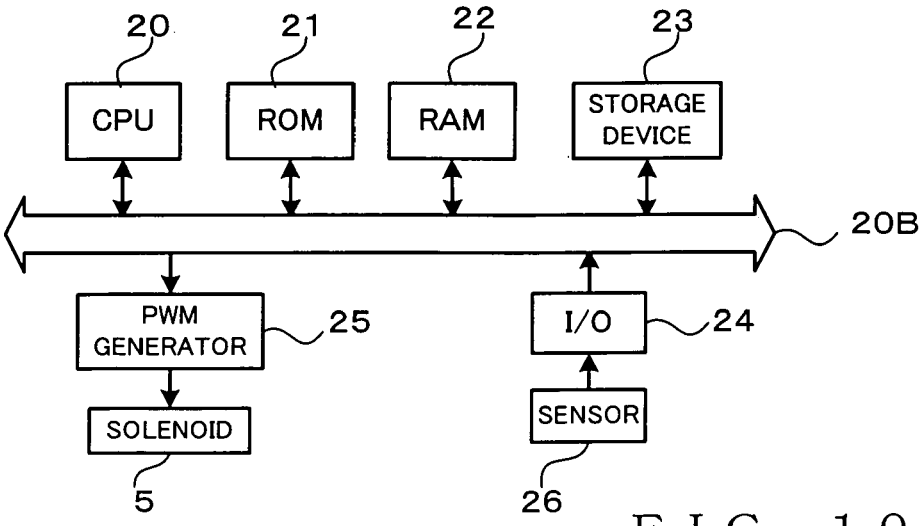
FIG. 4 is a diagram showing an example of a data table that indicates a transition over time of movement of a hammer in the automatic player piano of the present invention.
FIG. 5 is a diagram showing an example of a data table that is created on the basis of the data table of FIG. 4 and that indicates a transition over time of movement of the hammer in the automatic player piano of the present invention.
FIG. 10 is a block diagram showing an example electric hardware setup of the automatic player piano of the present invention.

At step S10, the signal processing section 27 takes in the A/D value from the hammer sensor 26 each time the routine is started up or triggered, and it stores the taken-in A/D value into the RAM along with corresponding time information TIM. In the illustrated example, the signal processing section 27 stores, in the RAM, twenty data sets composed of the A/D values taken in at twenty previous triggering occasions (or sampling points) from a given time point and corresponding time information TIME, and then creates a first data table TABLE1 as illustrated in FIG. 4 on the basis of the twenty data sets. In the data table TABLE1, as illustrated in FIG. 4, there are sequentially stored the data sets that are composed of the A/D values taken in at the twenty previous sampling points and corresponding time information TIM. In this way, the signal processing section 27 can acquire information indicative of successive operating-position information of the hammer 2 corresponding to a temporal transition within a predetermined time period.

At following step S11, a determination is made, on the basis of the taken-in A/D values, as to whether the hammer 2 has been operated, i.e. whether the key 1 corresponding to the hammer 2 has been operated by the human player. The determination as to whether or not the hammer 2 has been operated may be made by ascertaining, by reference to the rest value R, whether the A/D values taken in have varied from the value representing the non-depressed position (i.e., rest position). If the hammer 2 has not been operated (i.e., the key 1 has not been operated) as determined at step S11 (NO determination at step S11), the routine reverts to the beginning step (i.e., step S10).

If, on the other hand, the hammer 2 has been operated (i.e., the key 1 has been operated) as determined at step S11 (YES determination at step S11), it is further determined at step S12 whether the current taken-in A/D value has exceeded the second reference value m2 stored in the RAM, i.e., whether the stroke position of the hammer 2 has risen above the second reference position M2. Note that the "second reference position M2" is a pre-defined presumed string-striking position and "the string 4 has been struck by the hammer 2" can be presumed at the time point when the hammer 2 has risen above the second reference position M2. Thus presuming the string striking on the basis of the predefined presumed string-striking position and the A/D value output from the hammer sensor 26 is advantageous in that it can achieve an enhanced real-time processing capability with respect to the actual hammer movement and more prompt judgment of the hammer movement. However, because the second reference value m2, used here as a threshold value, is a value calculated, upon powering-on of the automatic player piano, on the basis of the actually-measured rest value R and calibration ratio, sufficient reliability can be ensured as long as the various parameters, such as the rest value R and calibration ratio, and actual outputs of the hammer sensor 26 are accurately associated with each other. Therefore, if the input/output characteristics of the hammer sensor 26 have varied due to variation over time or aging of the action mechanism 3 etc., then the association or correspondency between the outputs of the hammer sensor 26 and the parameters would become inaccurate, which would therefore prevent accurate presumption of string striking operation by the hammer 2. As will be apparent from a description to be later given, the instant embodiment employs arrangements for correcting any error caused by the action mechanism 3 to thereby correct the calibration ratio, so that the presumption of string striking operation by the hammer 2, based on the A/D value from the hammer sensor 26 and the predefined presumed string-striking position (threshold value), can be made with increased accuracy.

If the current taken-in A/D value has exceeded the second reference value m2 (threshold value) as determined at step S12, the routine goes to step S13 in order to set a first string-striking state st1, indicative of the operating state of the hammer 2 (i.e., whether the hammer 2 has struck the string 4), to one indicating that "occurrence of string-striking by the hammer 2 has been presumed". If, on the other hand, the current taken-in A/D value has not exceeded the second reference value m2, the first string-striking state st1 is set to one indicating that "occurrence of string-striking by the hammer 2 has not been presumed".

At next step S14, it is ascertained, with reference to the data table TABLE1, whether the operating (i.e., moving) direction of the hammer 2 has reversed at the fifth previous sampling point from a given one of the 20 sampling points. The time point when the operating direction of the hammer 2 has reversed can be identified, for example, on the basis of the first data table TABLE1 and incremental/decremental variation of the A/D value. For convenience of explanation, let it be assumed that the A/D value of the hammer 2 at its rest position takes a maximum value AD(MAX) while the A/D value of the hammer 2 at its end position takes a minimum value AD(MIN), in which case, within single-stroke displacement (i.e., displacement from the rest position to the end position and then back to the rest position), the A/D value output from the hammer sensor 26 gradually decreases from the maximum value AD(MAX) to reach the minimum value AD(MIN) at the top (corresponding to the end position) of the hammer's movement path and then gradually increases from the minimum value AD(MIN). Namely, the time point at which the A/D value variation has changed from the decreasing direction to the increasing direction can be considered to be the peak point of the hammer's movement (i.e., string-striking point), and the operating or moving direction of the hammer 2 reverses at such a point. Therefore, by checking, from the first data table TABLE1, the time point at which the A/D value variation has changed from the decreasing direction to the increasing direction, it is possible to identify the time point at which the moving direction of the hammer 2 has reversed.

Each time the instant routine is triggered, the signal processing section 27 checks, from the first data table TABLE1, the A/D values at and around the fifth previous sampling point from the latest sampling point and thereby identifies a time point at which the A/D value variation changes from the decreasing direction to the increasing direction. Then, the time point at which the moving direction of the hammer 2 has reversed is considered as a reference time point corresponding to the peak point of the hammer's movement (i.e., string-striking point), and the data sets at ten sampling points before and after the reference time point (i.e., five sampling points before the reference time point and five sampling points after the reference time point) are extracted to create a second data table TABLE2. Because, in this case, the reference time point corresponds to the fifth previous sampling point from the given sampling point (e.g., latest sampling point), the second data table TABLE2 comprises the data sets obtained at a total of 11 previous sampling points from the given sampling point.

In the second data table TABLE2, as illustrated in FIG. 5, there are stored the data sets ("AD(−5), t(−5)" to "AD(5), t(5)") at the 11 previous sampling points, and velocity information ("v(−4)" to "v(5)") and acceleration information ("a(−4)" to "a(4)") at the individual time points. Namely, the signal processing section 27 determines the reference time point (AD(0), t(0)) corresponding to the peak point of the hammer's movement (i.e., string-striking point), and respective velocity information and acceleration information at five sampling points before the reference time point and five sampling points after the reference time point. The velocity information at each of the time points can be calculated using, for example, the collinear approximation scheme on the basis of a difference between the data at any two desired ones of the sampling points (e.g., the data set at one of the sampling points and the data set at another sampling point immediately preceding the one sampling point). Further, the acceleration information can be calculated by performing a differential operation on the velocity information. Specific ways of calculating the velocity information and acceleration information may be other than the foregoing; any desired conventionally-known approaches may be used to calculate the velocity information and acceleration information. Because the velocity information can be calculated relatively easily on the basis of a difference between the data at any two desired ones of the sampling points as noted above, the velocity information may be calculated prior to the creation of the second data table TABLE2, e.g. when the first data table TABLE1 is created at step S10. If the velocity information at the individual sampling points is calculated prior to the creation of the second data table TABLE2, the velocity information can be used in determining, at step S14, whether the hammer 2 has reversed its moving or operating direction.

Figure 6:
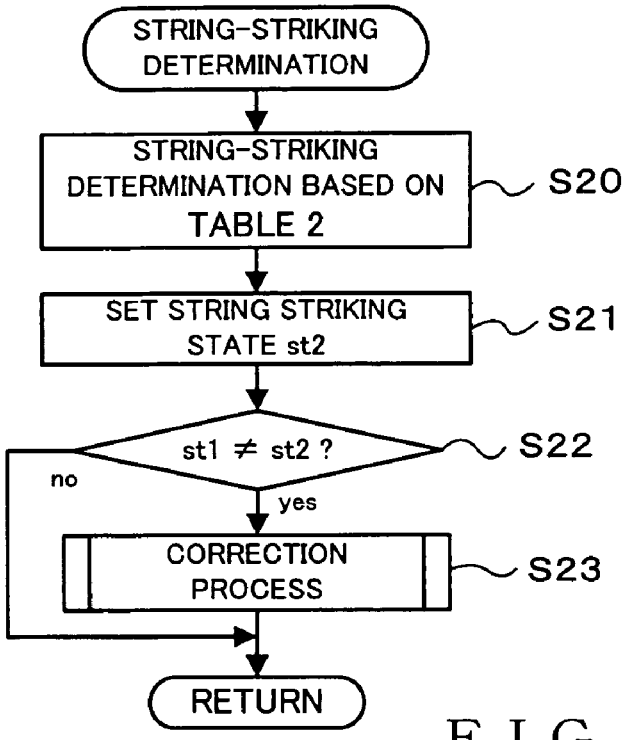
FIG. 6 is a flow chart showing an example operational sequence of a string-striking determination process carried out in the automatic player piano of the present invention.

If the hammer 2 has reversed its moving direction as determined at step S14 (YES determination at step S14), the hammer velocity determination routine moves on to step S15 in order to perform the "string-striking determination process" subroutine as will be detailed with reference to FIG. 6. If, on the other hand, the hammer 2 has not reversed its moving direction (NO determination at step S14), the current routine is continued without performing the "string-striking determination process" subroutine.

Now, an example operational sequence of the "string-striking determination process" will be described with reference to a flow chart of FIG. 6. First, at step S20, a determination is made, by reference to the second data table TABLE 2, whether the string 4 has been struck by the hammer 2. Specifically, whether or not the string 4 has been struck by the hammer 2 is determined by collating or comparing, with the following conditions, the velocity and acceleration information obtained when the hammer 2 approaches the string 4 (i.e., before striking the string 4) and velocity and acceleration information obtained when the hammer 2 moves away from the string 4 (i.e., after striking the string 4).

(1) Condition for determining that the string 2 has been actually struck by the hammer 2: Velocity information v(0) at the reference time point (AD(0), t(0)), velocity information v(−1) at a sampling time point (AD(−1), t(−1)) immediately preceding the reference time point and velocity information v(−2) at a second previous sampling point (AD(−2), t(−2)) from the reference time point is checked to determine whether or not any one of the checked velocities is greater than a predetermined velocity, e.g. 0.3 m/s. The above-mentioned velocity information v(0), v(−1) and v(−2) represents hammer velocities immediately before the string striking. In this way, it is possible to check a transition over time of the operating state of the hammer 2 approaching the string 4 before striking the string 4 and, if any one of the checked velocities is greater than the predetermined velocity, e.g. 0.3 m/s, it can be seen that the hammer 2 has been moving at a sufficient velocity to strike the string 4. Therefore, if this condition is met, the string-striking determination process can reliably determine that the hammer 2 has actually struck the string 4.

(2) Condition for determining that there is a high possibility that the hammer has struck the string 4: Absolute value a(0) of acceleration information at the reference time point (AD(0), t(0)) and absolute values a(−3) to a(−1)-a(1) to a(3) of acceleration information at three sampling points [(AD(−3), t(−3)) to (AD(−1), t(−1))] before the reference time point and three sampling points [(AD(1), t(1)) to (AD(3), t(3))] are checked to examine an operating state of the hammer 2 approaching the string 4 before striking the string 4 and an operating state of the hammer 2 moving away from the string 4 after the string striking. If the absolute value a(0) of acceleration information at the reference time point is the greatest of all the absolute values a(−3)-a(3) of the acceleration information, then the string-striking determination process can determine that there is a high possibility that the hammer 2 has struck the string 4.

(3) Condition for determining that there is a high possibility that the hammer 2 has not struck the string 4: If the condition in item (2) above is not met, i.e. if the absolute value a(0) of acceleration information at the reference time point is not the greatest of the absolute values a(−3) to a(3) and if the velocity information v(0) at the reference time point, determined by a quadratic curve adaptation scheme for adaptation to a quadratic curve obtained from a plurality of items of velocity information represents a value close to "0" (zero), then the string-striking determination process can determine that there is a high possibility that the hammer 2 has not struck the string 4. Namely, on condition that any one of the absolute values a(−3)-a (−1) and a(3)-a(1) is greater than the absolute value a(0), the string-striking determination process can determine that there is a high possibility that the hammer 2 has not struck the string 4. Further, where adapted velocity information v'(0) is calculated for the reference time point on the basis of the quadratic curve adaptation scheme based on the detected velocity information at the plurality of sampling points, and if the adapted velocity information v'(0) is close to "0", the string-striking determination process can similarly determine that there is a high possibility that the hammer 2 has not struck the string 4. Namely, even when the detected velocity information v(0) at the reference time point is not close to "0", it can be judged that there has occurred no sufficient movement of the hammer 2 for striking the string 4, as long as the adapted velocity information v'(0) calculated by the quadratic curve adaptation scheme (or other suitable smoothing scheme) is close to "0".

Namely, the string-striking determination process, which is carried out by reference to the second data table TABLE2 at step S20, determines whether the string 4 has been struck or has not been struck by the hammer 2, by checking a variation state of the hammer 2 approaching the string 4 before string the string 4 and a variation state of the hammer 2 moving away from the string 4 after striking the string 4 in terms of physical information of (i.e., velocity and acceleration information) indicative of movement of the hammer 2 within the movement range of the hammer 2 including the string-striking position (reference time point).

At step S21, a second string-striking state st2, indicative of an operating state (i.e., whether or not the hammer 2 has struck the string 4), is set in accordance with the result of the determination at step S20. The second string-striking state st2 may be set to merely indicate either that the string 4 has been struck by the hammer 2 (i.e., that condition (1) or (2) above has been met), or that the string 4 has not been struck by the hammer 2 (i.e., that condition (3) above has been met). Needless to say, the second string-striking state st2 may be set to indicate any one of the three states: (1) that the string 4 has been actually struck by the hammer 2; (2) that there is a high possibility that the string 4 has been struck by the hammer 2; and (3) that there is a high possibility that the string 4 has not been struck by the hammer 2, on the basis of conditions (1) to (3) above.

At next step S22, a comparison is made between the first string-striking state st1 and the second string-striking state st2 to check whether the two operating states (i.e., whether or not the string 4 has been struck) indicated by the two states st1 and st2 fail to match each other. If the two operating states do not agree with or match each other (Yes determination at step S22), the string-striking determination process moves on to step S23 in order to perform a "correction process". If, on the other hand, the two operating states st1 and st2 match each other (No determination at step S22), the processing section 27 terminates the string-striking determination process and returns to the "hammer velocity determination process" of FIG. 3.

Figure 7:
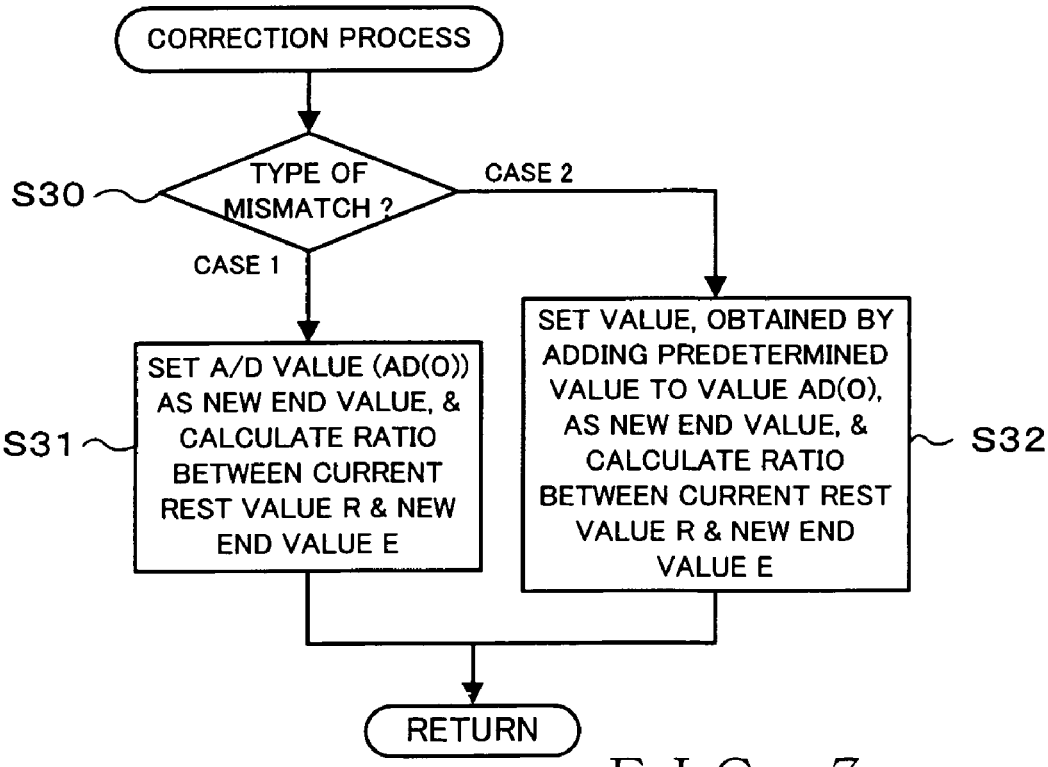
FIG. 7 is a flow chart showing an example operational sequence of a correction process carried out in the automatic player piano of the present invention.

The following paragraphs describe an example operational sequence of the correction process, with reference to FIG. 7.

First, at step S30, a determination is made as to which of the following cases the mismatch between the first and second string-striking states st1 and st2 corresponds to, and the string-striking presuming reference value is corrected or calibrated depending on the case.

1) Case 1 where the second string-striking state st2 indicates that the string 4 has been struck while the first string-striking state st1 presumes that the string 4 has not been struck: Because the string 4 has been actually struck although the first string-striking state presumes that the string 4 has not been struck, the reference end value E, used as a reference position parameter forming a basis of the first string-striking state st1, might have been set higher than the actual end position. Thus, in this Case 1, the correction process goes to step S31. At step S31, the A/D value (AD(0)) at a time point, set as the reference time point in the second data table TABLE2, is set as a new reference end value E and a ratio between the new reference end value E and the current rest value R is determined, to thereby update the calibration ratio of the hammer 2. After such updating of the calibration ratio, various parameters (i.e., reference position parameters etc.) are calculated again on the basis of the updated calibration ratio.

2) Case 2 where the second string-striking state st2 indicates that the string 4 has not been struck while the first string-striking state st1 presumes that the string 4 has been struck: Because the string 4 has not been actually struck although first string-striking state presumes that the string 4 has been struck, the reference end value E, used as a reference position parameter, might have been set lower than the actual end position. Thus, in this Case 2, the correction process goes to step S32. At step S32, a value, obtained by adding a predetermined value to the A/D value (AD(0)) at the time point set as the reference time point in the second data table TABLE2, is set as a new reference end value E and a ratio between the new reference end value E and the current rest value R is determined, to thereby update the calibration ratio of the hammer 2. After such updating of the calibration ratio, various parameters, including a threshold value corresponding to a presumed string-striking position (i.e., reference value m2 of the second reference position M2) etc. are calculated again on the basis of the updated calibration ratio. After that, the processing section 27 terminates the correction process and returns to the "hammer velocity determination process" of FIG. 3.

The above-described correction process can re-set the threshold value corresponding to the presumed string-striking position (i.e., second reference position M2) to a more appropriate value, by correcting the calibration ratio on the basis of the A/D values output in real time from the hammer sensor 26 during a performance on the automatic player piano. Thus, even when the calibration ratio has changed due to variation in the relative position of the action mechanism 3 caused by variation over time or aging, the calibration ratio can be corrected in real time. In this way, the correction process allows the string-striking determination, based on the output values (position information) from the hammer sensor 26 and presumed string-striking position, to be made with an enhanced accuracy.

Referring back to FIG. 3, at step S16 taken after the string-striking determination process and correction process contained therein, other processes are carried out, such as a process for generating a note-on/note-off signal (tone generation instructing signal) on the basis of the above-mentioned first string-striking state st1 and second string-striking state st2 set by the "string-striking determination process". The note-on/note-off signal is performance data including a key number and velocity data (i.e., data indicative of a string-striking velocity), which may be constructed, for example, in the MIDI format. According to the embodiment of the present invention, the above-described string-striking determining arrangements and calibration ratio correction permits the string-striking determination to be made with an enhanced accuracy, so that generation of the tone generation instructing signal and the like can be performed with higher accuracy. As a result, the instant embodiment can effectively prevent errors, such as unwanted omission of a tone that should be sounded and unwanted sounding of a tone that should not be sounded).

Modified embodiment of the calibration ratio correction process will now be described with reference to FIG. 8. At step S40, a determination is made as to whether the first and second string-striking states st1 and st2 have failed to match each other three or more times in succession. This means that the calibration calculating end value is updated on condition that the first and second string-striking states st1 and st2 have failed to match each other three or more consecutive times at step S22 in the string-striking determination process of FIG. 6. If the first and second string-striking states st1 and st2 have failed to match each other three or more times in succession (YES determination at step S40), the calibration ratio correction process goes to step S41, where it is determined which one of Case 1 and Case 2, having been set forth above with reference to FIG. 7, the mismatch between the first and second string-striking states st1 and st2 corresponds to. Such arrangements are intended to prevent the calibration ratio to be erroneously corrected in response to malfunction of the automatic player piano.

In Case 1, the reference end value E has been assumed to be higher than the actual end position, as noted above. Therefore, the following operations are carried out. At step S42, a peak point in the movement trajectory of the hammer 2 is found. For example, with reference to the second data table TABLE2 of FIG. 5, the A/D value at the reference time point AD(0), t(0), corresponding to the peak point of the hammer's movement (string-striking point), may be output as an A/D value at the peak (uppermost) position of the hammer's movement path. At step S43, a string-striking velocity is estimated from actual movement of the hammer 2. The string-striking velocity may be estimated, for example, with reference to the second data table TABLE2 of FIG. 5 by extracting A/D values at a plurality of sampling points (e.g., five sampling points) from among the stored movement measurements of the hammer 2 and then calculating a velocity from the extracted A/D values using the collinear approximation.

Figure 9:
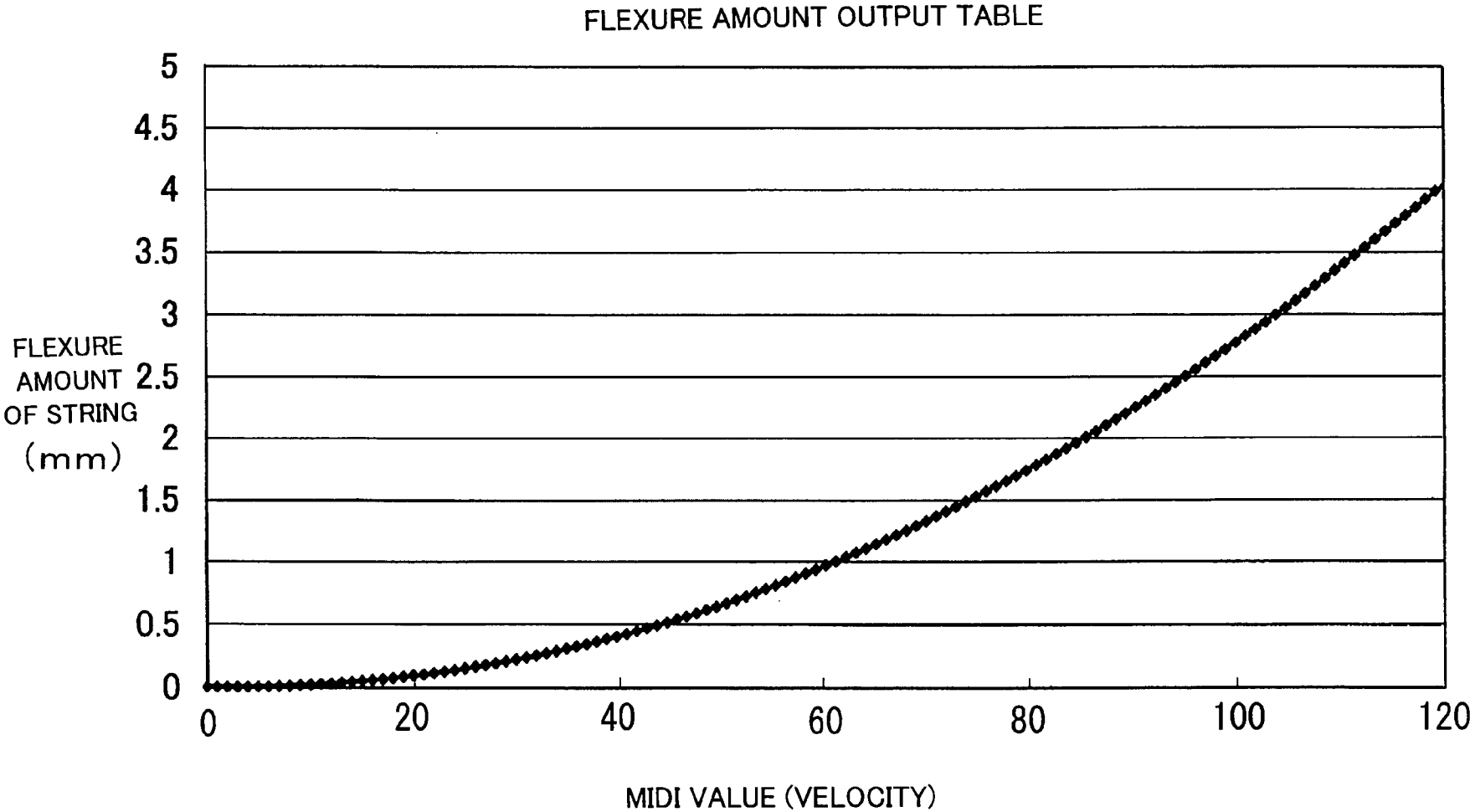
FIG. 9 is a diagram showing an example of a flexure amount output table employed in the automatic player piano of the present invention.

At step S44, a "flexure amount" x corresponding to the string-striking velocity is output with reference to a "flexure amount output table". One example of such a flexure amount output table is illustrated in FIG. 9, which defines correspondency between possible string-striking velocities and intensities of pressing force acting on the string 4 (i.e., flexure amounts of the string 4) when the hammer 2 driven at given velocity strikes the string 4. Let it be assumed here that the flexure amount output table is normally created using a predetermined test device and using a known end position, and that the thus-created table is stored in the automatic player piano. With the flexure amount x, corresponding to the string-striking velocity, output from the flexure amount output table of FIG. 9, the flexure amount of the string 4 caused by the string-striking operation is acquired. Occurrence of the flexure of the string 4 by the pressing of the hammer 2 means that the hammer 2 has moved beyond the end position (i.e., position at which the hammer 2 abuts against the string 4) by the flexure amount.

Thus, a value obtained by correcting the A/D value at the peak position (determined at step S42) with the flexure amount x obtained at step S44 may be considered as a value corresponding to the end position. At step S45, the A/D value at the peak position is output along with the new end value E calculated on the basis of the "flexure amount x".

In Case 2, the reference end value E has been assumed to be lower than the actual end position, as noted above. Therefore, at step S46, a peak point in the movement trajectory of the hammer 2 is found. For example, with reference to the second data table TABLE2 of FIG. 5, the reference time point AD(0), t(0) corresponding to the peak point of the hammer's movement (string-striking point) may be output as an A/D value at the peak (uppermost) position of the hammer's movement path. Because, in this case, the reference end value E has been assumed to be lower than the actual end position, the A/D value at the peak position of the hammer's movement may be output directly as a new end value E.

At step S47, the current rest value R and the new end value E are set as a calibration calculating rest value and calibration calculating end value, respectively. At next step S48, a calibration ratio is re-calculated on the basis of the thus-set calibration calculating rest value and calibration calculating end value.

Figure 8:
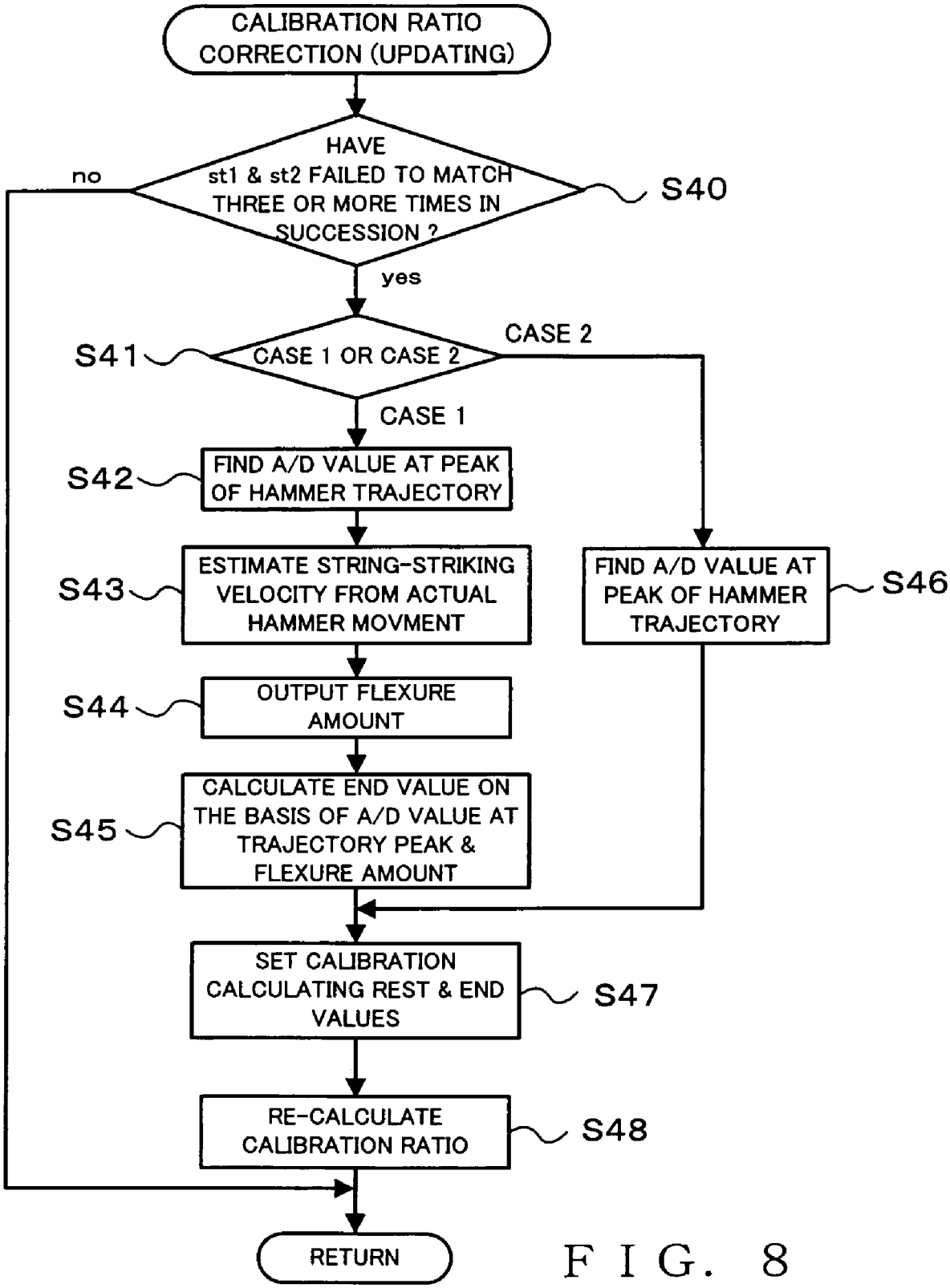
FIG. 8 is a flow chart showing an example operational sequence of another embodiment of the correction process carried out in the automatic player piano of the present invention.

As explained above, the modified embodiment of the correction process shown in FIG. 8 is arranged to update the calibration ratio on the basis of actual movement or operation of the hammer 2, so that it can deal with variation over time or aging of the hammer 2 etc. in a flexible manner. Further, the calibration ratio can be updated during normal operation of the automatic player piano, e.g. during recording or reproduction of a performance, in real time on the basis of actual movement or operation of the hammer 2, which permits the string-striking determination and generation of performance data to be carried out with an increased accuracy.

Whereas examples of the correction process have been described as correcting the calibration ratio, the present invention is not so limited. For example, the rest value R and end value E, set as reference position parameters, may be corrected, or the output values from the hammer sensor 26 may be corrected. Further, whereas the embodiments have been described as calculating the velocity information and acceleration information on the basis of the position information output from the hammer sensor (or successive physical amount sensor) 26, the present invention is not so limited. For example, the hammer sensor 26 may be constructed as a velocity sensor so that the position information and acceleration information is calculated on the basis of the velocity information output from the hammer sensor 26. In an alternative, the position information, velocity information and acceleration information may be provided separately by different sensors, i.e. position, velocity and acceleration, sensors. If the position, velocity and acceleration sensors are implemented by independent sensors, these sensors may have different detecting dimensions or a common detecting dimension. Further, the information to be used as factors for the string-striking determination of FIG. 6 is not limited to the velocity and acceleration information of the hammer 2; any other information may be used as such a string-striking determining factor as long as it is physical information related to string-striking movement of the hammer 2. For example, vibrations of the string 4 when struck by the hammer 2 may be detected by a suitable sensor so that the vibration information can be used as a string-striking determining factor. Alternatively, vibrating sound generated by the vibrations may be detected by a suitable pickup, instead of the vibrations of the string 4 being detected directly.

Furthermore, whereas the embodiments have been described as detecting movement of the keys and hammers of the automatic player piano, the present invention is not so limited, and the basic principles of the invention may be applied to any forms of apparatus as long as the apparatus determines abutting movement of an driven member drivable in response to operation of an operator member to abut against another member. For example, the present invention may be applied to a form of apparatus which successively detects abutting movement of a damper relative to a string in connection with relationship between the damper pedal and the damper.

Next, a description will be given about a second embodiment of the present invention, which is arranged to more accurately make a string-striking determination based on movement of the hammers 2 (i.e., displacement members movable in response to the corresponding keys) and make a determination as to whether or not generate tone-generation instructing information should be generated.

Let's assume that mechanical tone generation mechanisms and electric control system employed in the second embodiment of the automatic player piano are similar to those described above in relation to the first embodiment of FIG. 1. Therefore, the above descriptions of many parts of the tone generation mechanisms and electric control system in the first embodiment apply to the second embodiment as well. Therefore, the following paragraphs primarily describe characteristics features of the second embodiment that have not been described above in relation to the first embodiment.

FIG. 10 is a block diagram showing an example electric hardware setup of the second embodiment of the automatic player piano. The automatic player piano of FIG. 10 includes a CPU 20, a ROM 21, a RAM 22 and a storage device 23, which are interconnected via a data and address bus 20B. Outputs from the hammer sensor 26 are introduced, via an interface (I/O) 24 including an A/D converter, into a control system of the automatic player piano at a predetermined sampling frequency. The CPU 20 controls all operations of the automatic player piano and performs various signal processing including a performance data reproduction process, performance recording process, etc. Control programs for the various processes to be executed by the CPU 20 may be stored, for example, in the ROM 21. Further, in a suitable memory, such as the ROM 21 or RAM 22, there are stored various data produced during execution of the various signal processing, various parameters, various tables to be referred to by the CPU 20 during execution of the various signal processing. Further, the storage device 23 may be implemented by a suitable recording medium, such as a hard disk, flexible disk or floppy (trademark) disk, compact disk (CD-ROM), magneto-optical disk (MO), ZIP disk, DVD (Digital Versatile Disk) or semiconductor memory.

Relationship between the functional blocks of the system electric control shown in FIG. 1 and the blocks of FIG. 10 is explained below. The signal processing section 27 of FIG. 1 is a module that performs a process for generating performance data (i.e., performance recording process) on the basis of the outputs from the hammer sensor 26. Further, the pre-reproduction processing section 10, motion controller 11 and servo controller 12 of FIG. 1 together constitute a module that performs a process for reproducing performance data. Let's assume that, in the second embodiment, the signal processing to be carried out by each of the modules is implemented by software programs executed by the CPU 20. Of course, the signal processing to be carried out in the first embodiment can also be implemented by software programs executed by the CPU 20 using the hardware setup shown in FIG. 10.

As note earlier, the calculation section 28 and processing section 30 in the signal processing section 27 conceptually and extractively show the signal processing functions performed by the signal processing section 27. Further, the calculation section 28 is a module that, on the basis of A/D values (i.e., data representative of operating positions of the hammer 2) output from the hammer sensor 26, generates various performance-related information, such as information indicative of a string-striking time point and velocity. The processing section 30 is a module that, on the basis of the various information generated by the calculation section 28, generates performance data of a desired format, such as the MIDI format. Fundamentally, the performance data are key-on/key-off data including key numbers and velocity data (i.e., string-striking velocity data). The thus-generated performance data may be stored in the storage device 23. Also, the generated performance data may be supplied to external equipment via an input/output interface (not shown), or supplied in real time to another apparatus via a communication network (not shown). The servo controller 12 servo-controls the driving of the electromagnetic solenoid 5 by driving the solenoid 5 with an exciting current (e.g., PWM current signal generated by a PWM generator 25 of FIG. 2) based on the velocity indicating value Vr and a velocity signal Vy fed back from the solenoid 5.

Although outlines of operational sequences of performance recording (performance data generation) and reproduction processes, performed in the second embodiment of the automatic player piano, are similar to those in the first embodiment, they are explained briefly below. Human operator can instruct initiation of the performance recording process, for example, by operating a predetermined recording instructing switch provided on a controller or the like. The signal processing section 27 acquires various information related to a string-striking velocity, string-striking time point, etc. on the basis of the detected results of the hammer sensor 26, and it generates performance data, indicative of contents of a piano performance, on the basis of the various information. The thus-generated performance data may be stored in the storage device 23 (FIG. 10) and/or output to external equipment (not shown).

The human operator can also instruct initiation of the performance data reproduction process, for example, by operating a predetermined reproduction switch provided on the controller or the like. The pre-reproduction processing section 10 generates trajectory data, indicative of a movement trajectory of a key 1, on the basis of sequentially-supplied performance data, and an original velocity indicating value (t, Vr) of the key 1 using the trajectory data. The motion controller 11 generates a target velocity value Vr to be fed to the solenoid 5, on the basis of the original velocity indicating value (t, Vr). The servo controller 12 generates an exciting current for driving the solenoid 5, on the basis of the velocity indicating value Vr and velocity signal Vy fed back from the solenoid 5, and the solenoid 5 is driven by the exciting current. In this way, the key 1 is driven or depressed, along the stroke movement trajectory corresponding to the performance data, to cause the hammer 2 to strike the string 4 for a piano performance corresponding to the performance data. Also, the pre-reproduction processing section 10 controls the electronic tone generation section 13, on the basis of the performance data to be reproduced, so that the tone generation section 13 can electronically generate a tone corresponding to the performance data.

Further, processes similar to those described above with reference to FIGS. 2-9 are carried out in the second embodiment; thus, the second embodiment carries out a calibration method using a "calibration ratio" for calibrating temperature variation and variation over time or aging of the hammer sensor 26, as well as processes, similar to those in the first embodiment, intended to calibrate variation over time or aging etc. of the action mechanism of the hammer 2.

The first embodiment has been described above as employing the arrangements of FIG. 3 for the string-striking determination and velocity calculation in the hammer velocity determining routine carried out by the signal processing section 27. However, the second embodiment may employ arrangements of FIG. 11 without being limited to the arrangements of FIG. 3.

Figure 11:
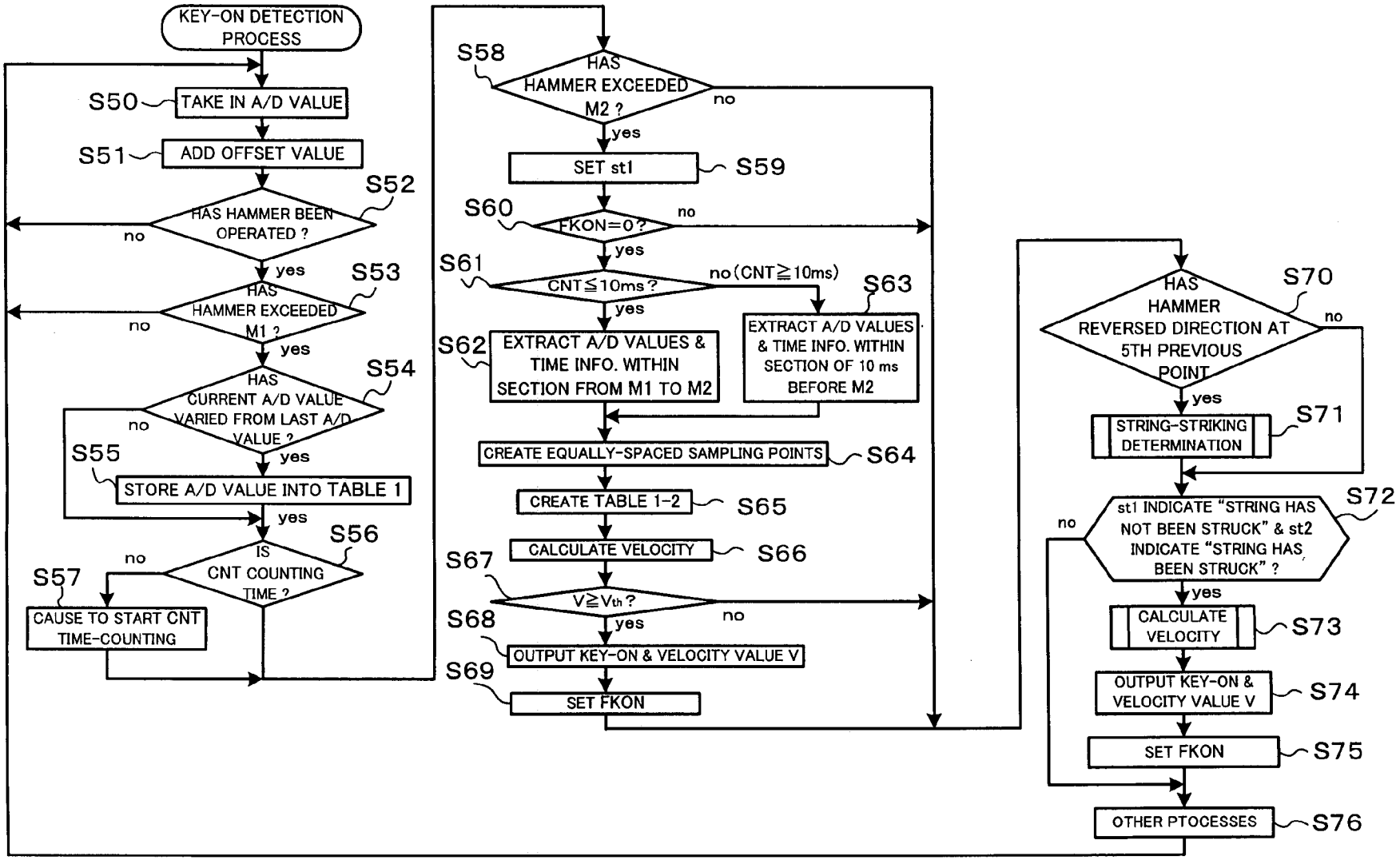
FIG. 11 is a flow chart showing an example operational sequence of another embodiment of the hammer velocity determination routine of FIG. 3, which particularly shows a key-on detection process.

FIG. 11 is a flow chart showing an example operational sequence of a key-on detection process (i.e., another embodiment of the hammer velocity determination routine of FIG. 3). This key-on detection process is carried out separately for each of 88 keys (i.e., hammers 2), but the following paragraphs representatively describe operations performed on only one of the keys (hammers 2).

This key-on detection process is carried out as one of principal routines in the performance recording process (performance data generation process) executed in response to performance operation by the human player, and it is triggered or started up every predetermined time (e.g., every 0.36 ms, i.e., at a frequency of 2.78 kHz). Namely, at step S50, A/D values output from the hammer sensor 26 are taken in at the predetermined time intervals (e.g., every 0.36 ms). At next step S51, an "offset value" is added to the taken-in A/D value; the "offset value" is an offset related to the output characteristic of the hammer sensor 26, which corresponds to a voltage taken out by the photo diode when the output A/D value is zero. The output characteristic of the sensor 26 is modified by the addition of the offset value to the output from the hammer sensor 26. As the offset value of the sensor 26, a specific value determined in advance for the sensor 26 may be stored in any desired storage device, such as the ROM 21 or RAM 22. By thus modifying the output characteristic of the sensor 26 with the offset value, a physical amount corresponding to displacement of the hammer 2 can be detected with an enhanced reliability.

At step S52, the taken-in A/D value and the rest value R stored as a reference value are compared to determine whether or not the hammer 2 (i.e., key 1) has been operated, in a similar manner to step S11 of FIG. 3. If the hammer 2 (i.e., key 1) has not been operated (NO determination at step S52), the key-on detection process reverts to step S50. At step S53, a comparison is made between the A/D value taken in at the current time and a threshold value indicative of the first reference position M1 (i.e., first reference value m1). If the current A/D value is greater than the reference value m1 (i.e., the operating position of the hammer 2 has not yet reached the first reference position M1) (NO determination at step S53), the process returns. If, on the other hand, the current A/D value is smaller than the reference value m1 (i.e., the operating position of the hammer 2 has passed beyond the first reference position M1) (YES determination at step S53), the process goes to step S54, where it is ascertained whether or not the current A/D value has varied from the last taken-in A/D value. If the current A/D value has varied from the last taken-in A/D value (YES determination at step S54), the process goes to step S55 in order to buffer the current A/D value and corresponding time information into the first data table TABLE1 of FIG. 4. In the above description of the "hammer velocity determining routine"

shown in FIG. 4, the data table TABLE1 has been described as containing twenty data sets that are composed of the A/D values taken at twenty previous sampling points before a given time point and corresponding time information TIME. However, in the instant modified embodiment, the data table TABLE1 is created by buffering the data for which the A/D value is smaller than the reference value m1 (the operating position of the hammer 2 has reached the first reference position M1) and has varied from the last taken-in A/D value. If the current A/D value has not varied from the last taken-in A/D value (NO determination at step S54), the process jumps over step S55 to step S56.

At steps S56 and S57, operations are carried out for causing a timer counter CNT to start a time-counting operation at a point when the current A/D value has exceeded the reference value m1. Namely, if the A/D value is smaller than the reference value m1 (the operating position of the hammer 2 has passed beyond the first reference position M1), and if the timer counter CNT is not currently counting the time (NO determination at step S56), then the timer counter CNT is caused to start time-counting. The timer counter CNT is one of parameters to be referred to as judging conditions for velocity calculation to be later described.

At step S58, a comparison is made between the A/D value taken in at the current time and a threshold value (i.e., second reference value m2) indicative of the second reference position M2 (i.e., immediately-before-string position that is 0.5 mm below the end position), to thereby determine whether the stroke position of the hammer 2 has reached the second reference position M2. If the current A/D value has exceeded the reference value m2 (YES determination at step S58), the routine goes to step S59, where the string-striking state st1 indicative of presence/absence of presumed string striking is set to one indicating that "occurrence of string striking has been presumed". As noted earlier, the string-striking state st1 is normally set to one indicating that "occurrence of string striking has not been presumed". At step S60, a "key-on flag FKON", indicative of presence/absence of a key-on signal output, is checked to determine whether a key-on signal has already been output. When the key-on flag FKON is at a value "1", it indicates that a key-on signal has been output, but, when the key-on flag FKON is at a value "0", it indicates that output of a key-on signal has not been instructed. If no key-on signal has been output yet (YES determination at step S60: FKON≠1), operations at and after step S61 are performed for determining a velocity of the hammer 2.

At steps S61-S66, operations are carried out for calculating a velocity (velocity value) of the hammer 2 on the basis of movement of the hammer 2 from the first reference position M1 to the second reference position M2.

At step S61, it is ascertained whether or not the count of the timer count CNT is equal to or smaller than 10 ms. Because, as noted above, the timer counter CNT starts time-counting at the time point when the current A/D value has exceeded the reference value m1, ascertaining whether the count of the timer count CNT is equal to or smaller than 10 ms can indicate whether the time the hammer 2 has taken to move from the first reference position M1 to the second reference position M2 is equal to or smaller than 10 ms or greater than 10 ms. If the count of the timer count CNT is equal to or smaller than 10 ms, the routine moves on to step S62; otherwise, the routine branches to step S63.

At step S62 taken as a result of the determination that the count of the timer count CNT is equal to or smaller than 10 ms, the A/D values and corresponding time information contained within a section from the first reference position M1 to the second reference position M2 are extracted as sampling points for determining a hammer trajectory within that section. Further, at step S63 taken as a result of the determination that the count of the timer count CNT is greater smaller than 10 ms, the A/D values and corresponding time information, contained within a time section of 10 ms before the time point when the hammer 2 has passed beyond the second reference position M2, are extracted as sampling points for determining a hammer trajectory within that section. Then, at step S64, interpolation is performed between the sampling points extracted at step S62 or 63 through the polynomial adaptation or otherwise and the thus-interpolated sampling points are converted to sampling points equally spaced from each other with a time interval Δt, so that five equally-spaced sampling points A0-A4 are extracted. These five equally-spaced sampling points A0-A4 will be used in the hammer velocity calculation. In the instant embodiment, the velocity information (data of velocity value V) of the hammer 2 is obtained using data obtained in a predetermined hammer stroke section (from the first reference position M1 to the second reference position M2) or predetermined time section (i.e., 10-ms time section before the second reference position M2).

FIGS. 12A and 12B are conceptual diagrams explanatory of the extraction of the equally-spaced sampling points carried out at steps S62-S64 above for hammer velocity calculation. In the figures, the horizontal axis represents the time t, the A/D values extracted as the sampling points for obtaining a hammer movement trajectory are depicted by small black circular dots, and the equally-spaced sampling points are depicted by star marks. FIG. 12A corresponds to step S62, while FIG. 12B corresponds to step S63. At step S62, as illustrated in FIG. 12A, the movement trajectory represented by the A/D values and corresponding time information contained in the section from the reference position M1 to the reference position M2 is divided into four regions with the time intervals Δt, and thus the five equally-spaced sampling points A0-A4 are extracted as sampling points to be used in the hammer velocity calculation. Also, at step S63, as illustrated in FIG. 12B, the movement trajectory represented by the A/D values and corresponding time information contained in the 10-ms before the second reference position M2 is divided into four regions with the time intervals A t, and thus the five equally-spaced sampling points A0-A4 are extracted as sampling points to be used in the hammer velocity calculation.

At step S65, a table TABLE 1-2 shown in FIG. 12C is created using the extracted five equally-spaced sampling points A0-A4 and time interval data Δt. As shown, the table TABLE1-2 is composed of the five equally-sampled A/D values AD[0]-AD[4] and time interval data Δt. At next step S66, velocity information (data of velocity value V) of the hammer 2 is obtained on the basis of the table TABLR1-2. The velocity of the hammer 2 may be calculated on the basis of the table TABLE 1-2 using the following mathematical expression:

$$(2*AD[0]+AD[1]-AD[3]-2*AD[4]/10*1/\Delta t*\alpha) \qquad \text{Mathematical Expression (1)}$$

, where α is a weighting coefficient for converting the AD value into a physical amount.

At step S67, the velocity value calculated at step S66 is compared with a predetermined velocity threshold value $V_{th}$ to thereby make a string-striking determination (key-on determination) based on the predetermined velocity condition. For example, the velocity threshold value $V_{th}$ is 0.4 m/s. If it is determined that the string 4 has not been struck by the hammer 2 (NO determination at step S67), operations at and after step S70 are carried out without a key-on signal being output.

If, on the other hand, it is determined that the string 4 has been struck by the hammer 2 on the basis of the comparison with the velocity threshold value $V_{th}$ (YES determination at step S67), the routine moves on to step S68 in order to output a key-on signal KON and the calculated velocity data. Then, at step S69, the key-on flag FKON is set to "1".

At step S70, it is ascertained, with reference to the data table TABLE1, whether the operating (i.e., moving) direction of the hammer 2 has reversed from the string-striking stroke (i.e., outward stroke) to the string-leaving or away-from-string stroke (i.e., homeward direction) at the fifth previous sampling point from the current sampling point, in a similar manner to step S14 above. If the operating direction of the hammer 2 has reversed (YES determination at step S70), a "string-striking determination process" subroutine is carried out at step S71, an example operational sequence of which is shown in FIG. 13.

Figure 13:
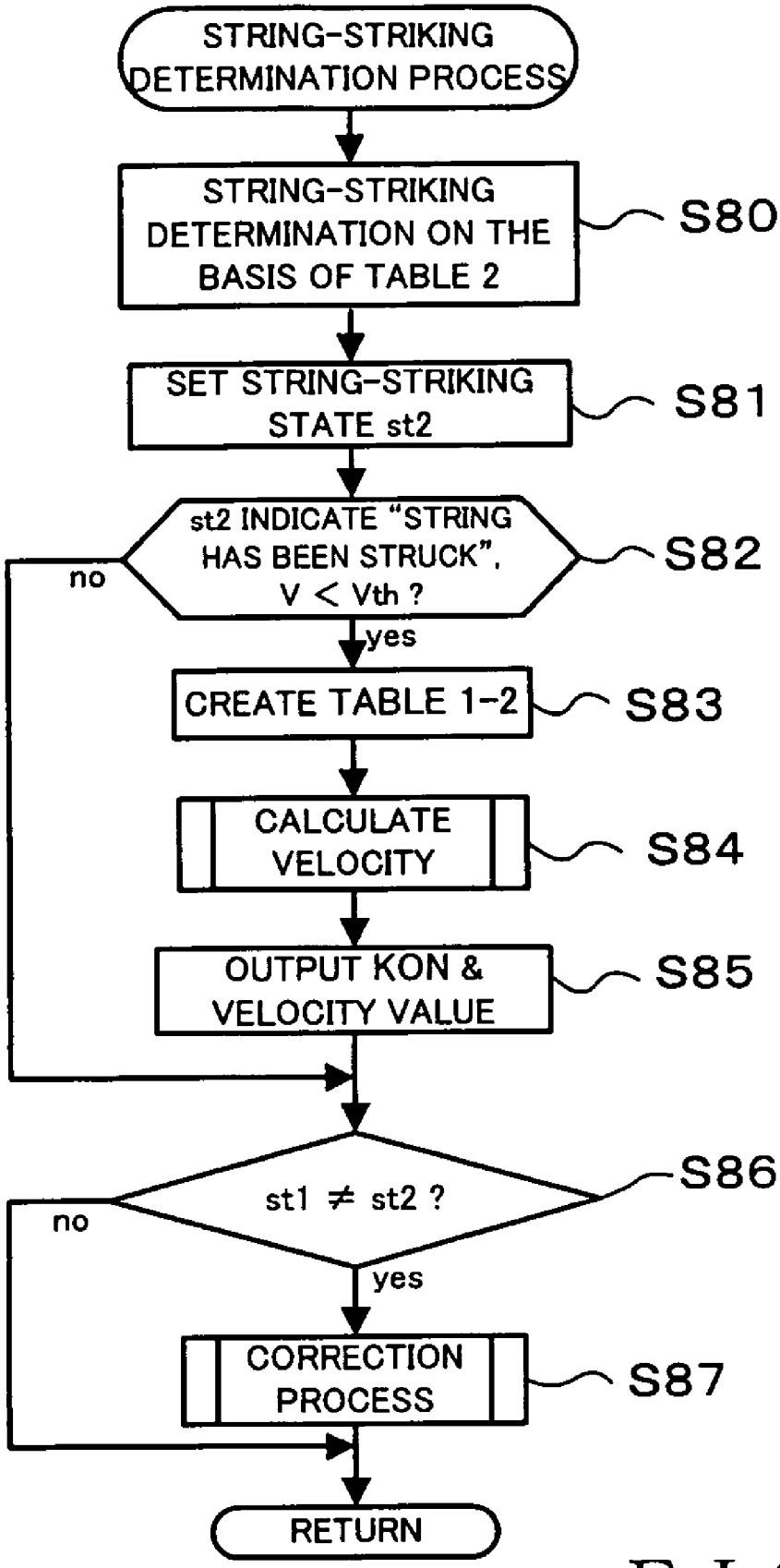
FIG. 13 is a flow chart showing an example operational sequence of a string-striking determination process carried out in the automatic player piano of the present invention.

In FIG. 13, a string-striking determination operation is carried out at step S80 on the basis of the table TABLE2 of FIG. 5. Details of the creation of the table TABLE2 and the string-striking determination operation may be similar to those explained above in relation to FIG. 6, and thus the details will not be explained here to avoid unnecessary duplication. At step S81, the string-striking state st2 is set at "1" or "0" on the basis of the string-striking determination result at step S80. Similarly to the above-mentioned, the string-striking state st2 set at "1" indicates that the string 4 has been struck by the hammer 2, while the string-striking state st2 set at "0" indicates that the string 4 has not been struck by the hammer 2.

At step S82, the string-striking state st2, velocity value V (calculated at step S66 of FIG. 11) and key-on flag FKON are checked, and a determination is made as to whether the calculated velocity value V has not exceeded the velocity threshold value $V_{th}$ ($V<V_{th}$) and the key-on flag FKON is "0" (i.e., no key-on signal is to be output). Thus, even when it is determined, through the comparison with the velocity threshold value $V_{th}$ at step S67, that the string 4 has not been struck by the hammer 2, a key-on signal is output through the following operations, if it is determined, on the basis of the table TABLE2, that the string 4 has been struck by the hammer 2 (YES determination at step S82). Namely, at step S83, the above-mentioned table TABLE1-2 is created by the following operations, and A/D values (AD[0]-AD[4]) at five sampling points A0-A4 are extracted from the table. Then, at step S84, a hammer velocity value V is calculated on the basis of the extracted A/D values AD[0]-AD[4], in a similar manner to step S66. At following step S85, a key-on signal and the calculated velocity value V are output, and the key-on flag FKON is set at "1".

At step S86, a comparison is made between the first string-striking state st1 set at step S59 of FIG. 11 and the second string-striking state st2 set at step S81, to determine whether the compared string-striking states match each other. If the compared string-striking states st1 and st2 do not match each other (YES determination at step S86), a "correction process" is carried out at step S87, which is similar to the correction process of FIG. 7. If, on the other hand, the compared string-striking states st1 and st2 match each other (NO determination at step S86), the signal processing section 27 terminates the instant string-striking determination routine and returns to the key-on detection process of FIG. 11.

Upon returning to the key-on detection process of FIG. 11, the signal processing section 27 checks, at step S72, the first string-striking state st1 set at step S59 of FIG. 11 and the second string-striking state st2 set at step S81. If the first string-striking state st1 indicates that the string 4 has not been struck by the hammer 2 (i.e., st1=0) while the second string-striking state st2 indicates that the string 4 has been struck by the hammer 2 (i.e., st2=1) (YES determination at step S72), operations are performed for outputting a key-on signal. Namely, a hammer velocity value V is determined, at step S73, through operations similar to steps S61-S66, and the key-on flag FKON is set at "1" at step S75. Then, the key-on detection process of FIG. 11 returns after carrying out other processes at step S76.

Through the above-described operations, the key-on detection process (i.e., routine for determining a velocity of the hammer 2) can perform key-on event detection (i.e., MIDI data output) with an enhanced accuracy in view of movement of the hammer approaching the string 4 before striking the string 4 and movement of the hammer moving away from the string 4 after striking the string 4.

As having been explained above, the embodiment of FIGS. 11-13 is arranged to not only output a key-on signal using a velocity value V of the hammer 2 during the outward (string-striking) stroke before the string striking and but also output a key-on signal using a velocity value V of the hammer 2 during the homeward (string-leaving) stroke after the string striking. With such arrangements, the embodiment can advantageously output more reliable tone-generation instructing (key-on) signals through more appropriate determination with enhanced real-time characteristics.

So far, the performance state determination in the above-described embodiments has been described as being made on the basis of predetermined operating positions (i.e., first and second reference positions M1 and M2) of the hammer 2. However, the present invention is not so limited. For example, operation detecting sensors may be provided on or in association with the keys 1 or other displacement members that are linked to performance operation, and suitable operating positions of each of the displacement members may be set as threshold values so that the performance state determination can be made on the basis of such threshold values. In this case too, the performance state determination concerns whether the hammer 2 has reached a predetermined position.

Further, in the above-described embodiments, the sensor 26 is in the form of a position sensor for detecting a stroke position of the corresponding hammer 2. Alternatively, the sensor 26 may be a velocity sensor or acceleration sensor. Further, the position, velocity and acceleration of the hammer 2 may be detected by separate sensors.

Furthermore, the various signal processing performed by the signal processing section 27, such as the hammer velocity determining routine, have been described above as implemented by software programs executed by a computer. However, the present invention is not so limited. For example, dedicated hardware signal processing devices may be used for performing the various arithmetic operations to be carried out by the individual modules constituting the signal processing section 27, and the various functions of the modules may be implemented by the hardware devices.

Furthermore, in the above descriptions of the first and second embodiments, the automatic player piano has been described as an acoustic piano having the automatic performance function and performance operation recording function. The acoustic piano may be either a grand piano or an upright piano. Moreover, the basic principles of the present invention may be applied to not only such automatic player pianos but also pianos with silencing capability.

What is claimed is:

1. A musical instrument comprising: a performance operator;

a hammer that is mechanically driven in response to operation of said performance operator so as to abut against an abutted member;

a detector that detects movement of said hammer;

a presumption section that, on the basis of outputs of said detector and a given reference value for defining a reference position slightly before a predetermined end position, presumes said hammer will abut against said abutted member when said hammer has reached the reference position;

a determination section that determines that said hammer mechanically driven has reached an abutting position where said hammer actually abuts against said abutted member; and a correction section that corrects a presuming condition to be used by said presumption section, in accordance with a presumption result of said presumption section and a determination result of said determination section.

2. A musical instrument as claimed in claim 1 wherein said correction section corrects the presuming condition to be used by said presumption section, by calibrating at least one of the output of said detector and the reference value.

3. A musical instrument as claimed in claim 1 wherein the outputs of said detector is information indicating movement of said hammer in a first type of physical amount, and wherein said determination section determines that said hammer has reached said abutting position, on the basis of information indicating, in a second type of physical amount, movement of said hammer in a movement range of said hammer including said abutting position.

4. A musical instrument as claimed in claim 1 wherein said detector is a position sensor that successively detects a moving position of said hammer, and wherein said determination section calculates at least one of a velocity and acceleration of said hammer on the basis of position information detected by said position sensor, and, on the basis of a transition over time of the calculated, at least one of the velocity and acceleration of said hammer in the movement range, said determination section determines whether said hammer has reached said abutting position.

5. A musical instrument as claimed in claim 1 wherein, when a presumption result of said presumption section has differed from the determination result of said determination section a plurality of times in succession, said correction section corrects the presuming condition in accordance with the determination result of said determination section.

6. A musical instrument as claimed in claim 5 wherein said correction section corrects the presuming condition by correcting the reference value.

7. A musical instrument as claimed in claim 1 wherein said presumption section determines, in real time responsive to the movement of said hammer, whether said hammer has reached the reference position, and wherein, when said hammer has reached the reference position, said presumption section presumes that said hammer will abut against said abutted member, and generates, in accordance with the presumption, tone-controlling or performance-controlling event data corresponding to the abutment, against said abutted member, of said hammer.

8. A musical instrument as claimed in claim 7 wherein said determination section determinately determines, with a slight delay behind the movement of said hammer, that said hammer has reached said abutting position.

9. A musical instrument as claimed in claim 1 which is in the form of a piano, and wherein said performance operator is a key of said piano, said hammer is a hammer of said piano, and said abutted member is a string of the piano.

10. A musical instrument as claimed in claim 1 wherein said performance operator is a pedal for controlling a performance.

11. A musical instrument as claimed in claim 1 wherein, when said hammer has moved, said presumption section generates a first flag indicating whether or not it has been presumed that said hammer will abut against the abutted member, and said determination section generates a second flag indicating whether or not it has been determined that said hammer has reached the abutting position where said hammer actually abuts against the abutted member, an wherein, when the first and second flags do not agree with each other, said correction section corrects said presuming condition in accordance with a state of disagreement between the first and second flags.

12. A computer-readable storage medium storing a program for causing a computer of a musical instrument to calibrate a detection system of said musical instrument, said musical instrument including: a performance operator; a hammer that is mechanically driven in response to operation of said performance operator so as to abut against an abutted member; and a detector that detects movement of said hammer, said program comprising:

a presumption step of, on the basis of outputs of said detector and a given reference value for defining a reference position slightly before a predetermined end position, presuming said hammer will abut against said abutted member when said hammer has reached the reference position;

a determination step of determining that said hammer mechanically driven has reached an abutting position where said hammer actually abuts against said abutted member; and a correction step of correcting a presuming condition to be used by said presumption step, in accordance with a presumption result of said presumption section and a determination result of said determination step.

13. A computer-readable storage medium as claimed in claim 12 wherein said correction step corrects the presuming condition to be used by said presumption step, by calibrating at least one of the output of said detector and the presuming reference value.

14. A musical instrument comprising:

a performance operator;

a hammer that reciprocatively moves in response to operation of said performance operator so as to abut against an abutted member;

a detector that successively detects operation of said hammer to output detection outputs that are information indicating movement of said hammer in a first type of physical amount;

a calculation section that calculates information indicating the movement of said hammer in a second type of physical amount, using discrete values of the detection outputs of said detector and on the basis of a given approximate expression; and a determination section that determines that said hammer has reached an abutting position, where said hammer actually abuts against said abutted member, by comparing, on the basis of detection the information indicating, in a second type of physical amount, movement of said hammer in a movement range of said hammer including said abutting position, movement of said hammer toward said abutted member and movement of said hammer away from said abutted member.

15. A musical instrument as claimed in claim 14 which further comprises a presumption section that, on the basis of the outputs of said detector and a given presuming reference value for defining a reference position slightly before a predetermined end position, presumes said hammer will abut against said abutted member when said hammer has reached the reference position.

16. A musical instrument as claimed in claim 14 wherein said detector is a position sensor that successively detects a moving position of said hammer, and wherein said determination section calculates at least one of a velocity and acceleration of said hammer on the basis of position information detected by said position sensor, and, on the basis of a transition over time of the calculated, at least one of the velocity and acceleration of said hammer in the movement range, said determination section determines whether said hammer has reached said abutting position.

17. A computer-readable storage medium storing a program for causing a computer of a musical instrument to perform a performance operation determination, said musical instrument including: a performance operator; a hammer that reciprocatively moves in response to operation of said performance operator so as to abut against an abutted member; and a detector that successively detects operation of said hammer, said program comprising:

a detection step of detecting the operation of said hammer to output detection outputs that are information indicating movement of said hammer in a first type of physical amount;

a calculation step of calculating information indicating the movement of said hammer in a second type of physical amount, using discrete values of the detection outputs of said detector and on the basis of a given approximate expression; and a determination step of determining that said hammer has reached an abutting position where said hammer actually abuts against said abutted member, by comparing, on the basis of the information indicating, in a second type of physical amount, movement of said hammer in a movement range of said hammer including said abutting position, movement of said hammer toward said abutted member and movement of said hammer away from said abutted member.

18. A musical instrument comprising:

a performance operator;

a displacement member that reciprocatively moves in response to operation of said performance operator so as to control tone generation by a tone generation section;

a detector that detects movement of at least one of said performance operator and said displacement member;

a position determination section that determines, on the basis of outputs of said detector, whether said displacement member has reached a predetermined position;

a velocity information generation section that acquires velocity information of said displacement member on the basis of the outputs of said detector;

a velocity determination section that determines whether a velocity indicated by the velocity information outputted by said velocity information generation section has exceeded a predetermined velocity; and a tone-generation instructing information generation section that generates tone-generation instructing information on the basis of determination results of said position determination section and said velocity determination section, wherein, when said velocity determination section determines that the velocity indicated by the velocity information has exceeded the predetermined velocity, said tone-generation instructing information generation section generates tone-generation instructing information on the basis of at least the velocity information obtained during outward movement of said displacement member toward said predetermined position, but, when said velocity determination section determines that the velocity indicated by the velocity information has not exceeded the predetermined velocity, said tone-generation instructing information generation section generates tone-generation instructing information on the basis of at least the velocity information obtained during homeward movement of said displacement member away from said predetermined position.

19. A method for generating tone-generation instructing information on the basis of operation of a displacement member that reciprocatively moves in response to operation of said performance operator, said method comprising:

a detection step of detecting movement of at least one of said performance operator and said displacement member;

a position determination step of determining, on the basis of detection results of said detection step, whether said displacement member has reached a predetermined position;

a velocity information output step of generating velocity information of said displacement member on the basis of the detection results of said detector;

a velocity determination step of determining whether a velocity indicated by the velocity information outputted by said velocity information output step has exceeded a predetermined velocity; and a tone-generation instructing information generation step of generating tone-generation instructing information on the basis of determination results of said position determination step and said velocity determination step, wherein, when said velocity determination step determines that the velocity indicated by the velocity information has exceeded the predetermined velocity, said tone-generation instructing information generation step generates tone-generation instructing information on the basis of at least the velocity information obtained during outward movement of said displacement member toward said predetermined position, but, when said velocity determination step determines that the velocity indicated by the velocity information has not exceeded the predetermined velocity, said tone-generation instructing information generation step generates tone-generation instructing information on the basis of at least the velocity information obtained during homeward movement of said displacement member away from said predetermined position.

20. A computer-readable storage medium storing a program for causing a computer to perform a method for generating tone-generation instructing information on the basis of operation of a displacement member that reciprocatively moves in response to operation of said performance operator, said method comprising:

a detection step of detecting movement of at least one of said performance operator and said displacement member;

a position determination step of determining, on the basis of detection results of said detection step, whether said displacement member has reached a predetermined position;

a velocity information output step of generating velocity information of said displacement member on the basis of the detection results of said detector;

a velocity determination step of determining whether a velocity indicated by the velocity information outputted by said velocity information output step has exceeded a predetermined velocity; and a tone-generation instructing information generation step of generating tone-generation instructing information on the basis of determination results of said position determination step and said velocity determination step, wherein, when said velocity determination step determines that the velocity indicated by the velocity information has exceeded the predetermined velocity, said tone-generation instructing information generation step generates tone-generation instructing information on the basis of at least the velocity information obtained during outward movement of said displacement member toward said predetermined position, but, when said velocity determination step determines that the velocity indicated by the velocity information has not exceeded the predetermined velocity, said tone-generation instructing information generation step generates tone-generation instructing information on the basis of at least the velocity information obtained during homeward movement of said displacement member away from said predetermined position.

* * * * *